US006742321B2

(12) United States Patent
Gates

(10) Patent No.: US 6,742,321 B2
(45) Date of Patent: Jun. 1, 2004

(54) FLANGE ALIGNMENT AND GRASPING ASSEMBLY FOR BAG HANDLING APPARATUS

(75) Inventor: Christopher G. Gates, Limaville, OH (US)

(73) Assignee: Gates Automation, Inc., Sebring, OH (US)

( * ) Notice: Subject to any disclaimer, the term of this patent is extended or adjusted under 35 U.S.C. 154(b) by 0 days.

(21) Appl. No.: 10/261,512

(22) Filed: Sep. 30, 2002

(65) Prior Publication Data

US 2004/0060266 A1 Apr. 1, 2004

(51) Int. Cl.[7] ..... B65B 43/26

(52) U.S. Cl. ..... 53/570; 53/468; 53/573; 53/284.7; 53/373.6; 53/481

(58) Field of Search ..... 53/570, 468, 469, 53/573, 284.7, 373.6, 481

(56) References Cited

U.S. PATENT DOCUMENTS

| | | | |
|---|---|---|---|
| 1,007,918 | A | 11/1911 | Chambers |
| 2,329,360 | A | 9/1943 | Salfisberg |
| 2,842,921 | A | 7/1958 | Rasmusson |
| 2,999,627 | A | 9/1961 | Reinhardt |
| 3,008,837 | A | 11/1961 | Kaplan |
| 3,155,282 | A | 11/1964 | Leblanc |
| 3,342,326 | A | 9/1967 | Zackheim |
| 3,372,857 | A | 3/1968 | Brayla |
| 3,625,351 | A | 12/1971 | Eisenberg |
| 3,731,454 | A | 5/1973 | Crabb |
| 3,768,725 | A | 10/1973 | Pilaro |
| 3,799,914 | A | 3/1974 | Schmit et al. |
| 3,822,527 | A | 7/1974 | Germunson et al. |
| 3,938,299 | A | 2/1976 | Lerner |
| 3,948,015 | A | 4/1976 | Lerner |
| 3,956,866 | A | 5/1976 | Lattur |
| 3,980,225 | A | 9/1976 | Kan |
| 3,983,994 | A | 10/1976 | Wyslotsky |
| 4,014,154 | A | 3/1977 | Lerner |
| 4,037,387 | A | 7/1977 | Orikawa |
| 4,041,846 | A | 8/1977 | Lerner |
| 4,078,358 | A | 3/1978 | Henderson |
| 4,095,723 | A | 6/1978 | Lerner |
| 4,115,978 | A | 9/1978 | Langemeyer et al. |
| 4,176,567 | A | 12/1979 | Weisberg |
| 4,201,029 | A | 5/1980 | Lerner et al. |
| 4,202,153 | A | 5/1980 | Lerner et al. |
| 4,247,019 | A | 1/1981 | Lerner |
| 4,263,768 | A | 4/1981 | Russell et al. |
| 4,337,058 | A | 6/1982 | Lerner |
| 4,344,557 | A | 8/1982 | Lerner |
| 4,350,243 | A | 9/1982 | Weyandt |
| 4,354,618 | A | 10/1982 | Weyandt |
| 4,368,608 | A | 1/1983 | Ray |
| 4,382,527 | A | 5/1983 | Lerner |
| 4,387,550 | A | 6/1983 | Lerner |
| 4,392,056 | A | 7/1983 | Weyandt |
| 4,401,213 | A | 8/1983 | Lerner |
| 4,412,876 | A | 11/1983 | Lerner et al. |

(List continued on next page.)

*Primary Examiner*—Stephen F. Gerrity
*Assistant Examiner*—Hemant M. Desai
(74) *Attorney, Agent, or Firm*—Sand & Sebolt

(57) ABSTRACT

A flange alignment and grasping assembly is adapted to straighten the flanges of a bag in a filling and sealing apparatus so that the flanges may be clamped by the assembly. The assembly includes opposed guides that engage the side of the bag in the general location of the flange. The guides position the flange in an extended position between the jaws of a clamp where the clamp will pinch the flange when the clamp closes. The invention also provides an apparatus for grasping a bag and pulling a portion of the bag tight. In one embodiment, an apparatus includes arms that swing upwardly and inwardly to position jaws with respect to the bag.

42 Claims, 24 Drawing Sheets

U.S. PATENT DOCUMENTS 4,423,583 A * 1/1984 Carey ..... 52/373
4,432,186 A 2/1984 McGregor
4,467,207 A 8/1984 Lerner et al.
4,510,736 A 4/1985 Muller
4,565,592 A 1/1986 Wehrmann et al.
4,575,901 A 3/1986 Lerner
4,588,392 A 5/1986 Maddock
4,589,165 A 5/1986 Lerner et al.
4,598,826 A 7/1986 Shinbach
4,613,320 A 9/1986 Lerner
4,620,888 A 11/1986 Easter et al.
4,651,506 A 3/1987 Lerner et al.
4,652,253 A 3/1987 Benoit
4,680,205 A 7/1987 Lerner et al.
4,726,170 A 2/1988 Sawa et al.
4,745,658 A 5/1988 Lerner
RE32,963 E 6/1989 Lerner et al.
4,843,796 A 7/1989 Furukawa
4,899,520 A 2/1990 Lerner et al.
4,901,506 A 2/1990 Weyandt
4,914,895 A 4/1990 Kuckhermann et al.
4,926,048 A 5/1990 Lerner et al.
4,928,455 A 5/1990 Gereby et al.
4,944,825 A 7/1990 Gifford et al.
4,945,252 A 7/1990 Lerner et al.
4,961,503 A 10/1990 Bell
4,969,310 A 11/1990 Lerner et al.
5,041,148 A 8/1991 Gereby et al.
5,046,621 A 9/1991 Bell
5,057,824 A 10/1991 Stokes
5,059,114 A 10/1991 Stout et al.
5,070,674 A 12/1991 Lerner et al.
5,077,958 A 1/1992 Peppard et al.
5,134,833 A 8/1992 Lerner et al.
5,174,449 A 12/1992 Ball
5,177,939 A 1/1993 Lipes
5,222,535 A * 6/1993 Roders ..... 141/314
5,232,541 A 8/1993 Gifford
5,259,172 A 11/1993 Peppard et al.
5,265,402 A 11/1993 Lerner et al.
5,289,671 A 3/1994 Lerner et al.
5,301,492 A * 4/1994 Kader ..... 53/459
5,301,889 A 4/1994 Ball
5,304,264 A 4/1994 Wehrmann
5,310,056 A 5/1994 Ball
5,341,625 A 8/1994 Kramer
5,371,521 A 12/1994 Wehrmann
5,375,396 A * 12/1994 Huwelmann ..... 53/502
5,394,674 A 3/1995 Peppard et al.
5,394,676 A 3/1995 Lerner et al.
5,411,627 A 5/1995 Lerner et al.
5,417,639 A 5/1995 Cronauer
5,426,918 A 6/1995 Ball
5,435,114 A * 7/1995 Moehlenbrock et al. ..... 53/434
5,470,419 A 11/1995 Sasaki et al.
5,474,208 A 12/1995 Ball
5,499,485 A 3/1996 Lerner et al.
5,535,792 A 7/1996 McGregor
5,568,718 A 10/1996 Lerner et al.
5,570,568 A 11/1996 Kramer
5,586,708 A 12/1996 Lerner et al.
5,600,360 A 2/1997 Lerner et al.
5,619,839 A 4/1997 Peppard et al.
5,626,004 A 5/1997 Gates et al.
5,640,834 A 6/1997 Lerner et al.
5,664,406 A * 9/1997 Smith ..... 53/459
5,671,787 A 9/1997 Wehrmann
5,711,751 A 1/1998 Harmanoglu
5,722,218 A 3/1998 Lerner
5,743,070 A 4/1998 Lerner et al.
5,771,667 A 6/1998 McGregor et al.
5,772,565 A 6/1998 Weyandt
5,806,276 A 9/1998 Lerner et al.
5,819,509 A * 10/1998 McGregor et al. ..... 53/525
5,878,553 A 3/1999 Schlosser
5,887,412 A 3/1999 Lerner et al.
5,890,346 A 4/1999 Guess
5,915,555 A 6/1999 Ball
5,944,424 A 8/1999 Lerner et al.
5,945,252 A 8/1999 Sokoluk et al.
5,957,824 A 9/1999 Lerner et al.
5,987,856 A 11/1999 Lerner
5,996,319 A 12/1999 Lerner et al.
6,035,611 A 3/2000 Lerner
6,055,796 A 5/2000 Lerner et al.
RE36,759 E 7/2000 Hoover et al.
6,134,864 A * 10/2000 McGregor et al. ..... 53/459
6,138,723 A * 10/2000 Wagner ..... 141/313
6,170,238 B1 1/2001 Lerner
6,199,349 B1 3/2001 Lerner
6,226,963 B1 * 5/2001 Rychlak et al. ..... 53/473
6,276,117 B1 * 8/2001 Wiles ..... 53/570
6,318,893 B1 * 11/2001 Gates ..... 383/200
6,351,926 B1 3/2002 Hodge et al.
6,367,975 B1 4/2002 Cronauer et al.
6,401,439 B1 * 6/2002 Tetenborg et al. ..... 53/567
6,516,587 B1 * 2/2003 Chikatani ..... 53/459
6,550,226 B1 * 4/2003 Gates et al. ..... 53/459

* cited by examiner

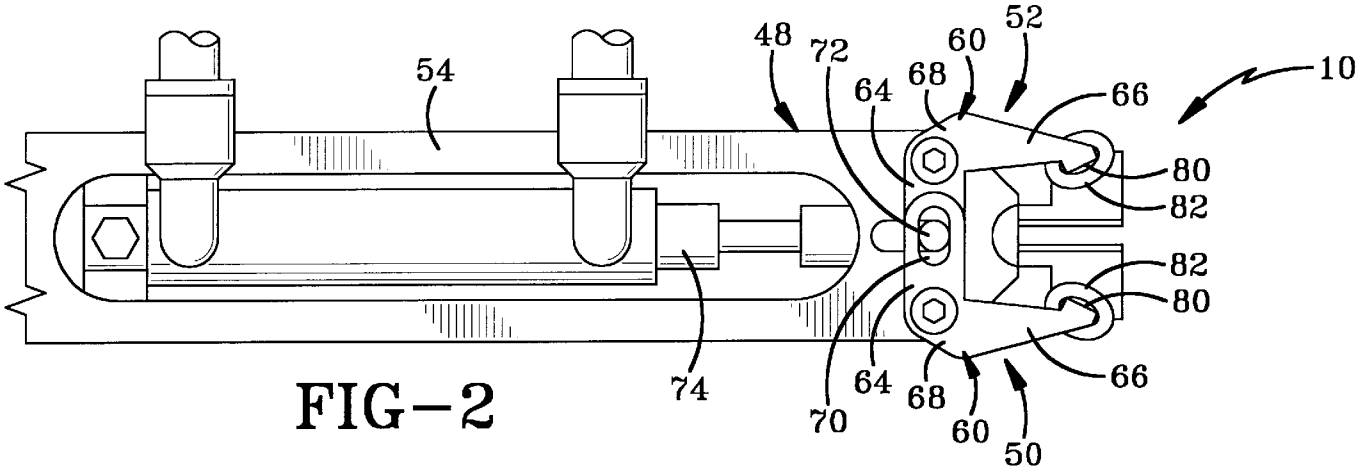
FIG-2
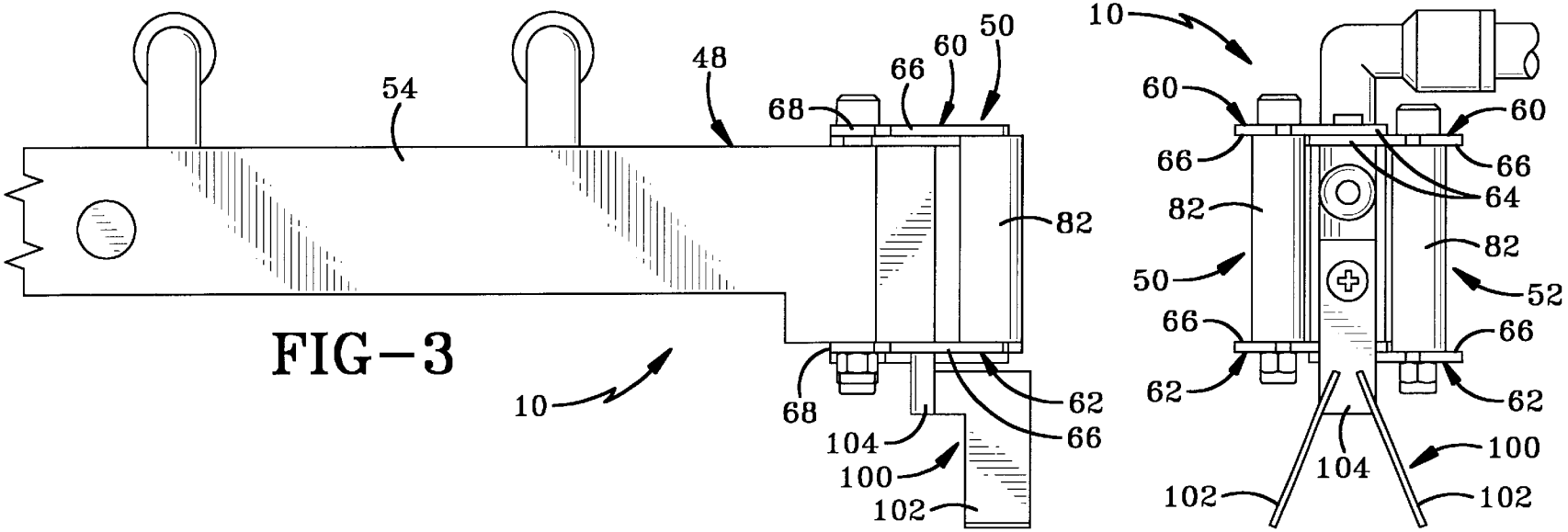
FIG-3
FIG-4

FLANGE ALIGNMENT AND GRASPING ASSEMBLY FOR BAG HANDLING APPARATUS

BACKGROUND OF THE INVENTION

1. Technical Field

The present invention generally relates to bag filling and sealing apparatus and, more particularly to the assemblies of these apparatus that hold the bags while the bags are filled or sealed. Specifically, the present invention relates to an assembly that aligns the flanges on the sides of a bag so that the flanges may be grasped by gripping jaws.

2. Background Information

Packaging various items in plastic bags is becoming increasingly popular in the packaging and food packaging industry. Plastic bags are inexpensive to manufacture and have the ability to keep food fresher than other types of traditional packaging. Some types of plastic bags may include a resealable closure. Problems have occurred in the food industry in filling these bags leading some packaging companies to fill the bags by hand. Filling bags by hand is expensive and increases the probability of food contamination.

One prior art apparatus that automatically fills and seals these bags is disclosed in application Ser. No. 09/698,830 filed Oct. 27, 2000 owned by the assignee of this application. This apparatus uses fingers that pinch the upper corners of the bag. One of the fingers is thus inserted into the bag when the corners are pinched. After the bag is filled, the upper portion of the bag is removed as a waste strip. The art desires a bag grasping assembly that holds the bag by the flanges of the bag with no portion of the grasping assembly being positioned in the bag.

One problem with grasping the flanges of the bag is that the flanges are often flat against the sidewall of the bag when the flanges must be grasped. The art desires a flange-grasping assembly that positions the flanges in an extending grasping position just before the grasping assembly arrives to clamp the flange. The art also desires an assembly that can reliably grasp the flanges while eliminating essentially all misses to increase the efficiency of the apparatus.

BRIEF SUMMARY OF THE INVENTION

The invention provides a flange alignment and grasping assembly that is adapted to straighten the flanges of a bag in a filling and sealing apparatus so that the flanges may be clamped by the assembly. The assembly includes opposed guides that engage the side of the bag in the general location of the flange. The guides position the flange in an extended position between the jaws of a clamp where the clamp will pinch the flange when the clamp closes.

Different embodiments of the guides are disclosed with the guides having different shapes and different mounting locations.

The invention also provides an apparatus for grasping a bag and pulling a portion of the bag tight. The apparatus includes arms that swing upwardly and inwardly to engage the flanges of the bag. Portions of the arms then move outwardly to pull the bag tight.

BRIEF DESCRIPTION OF THE SEVERAL VIEWS OF THE DRAWINGS

FIG. 2 is a top view of one of the bag grasping arms incorporating a the first embodiment of the flange alignment and grasping assembly of the present invention.

FIG. 3 is a side view of the arm of FIG. 2.

FIG. 4 is an end view of the arm of FIG. 2.

Similar numbers refer to similar elements throughout the specification.

DETAILED DESCRIPTION OF THE INVENTION

Figure 1:
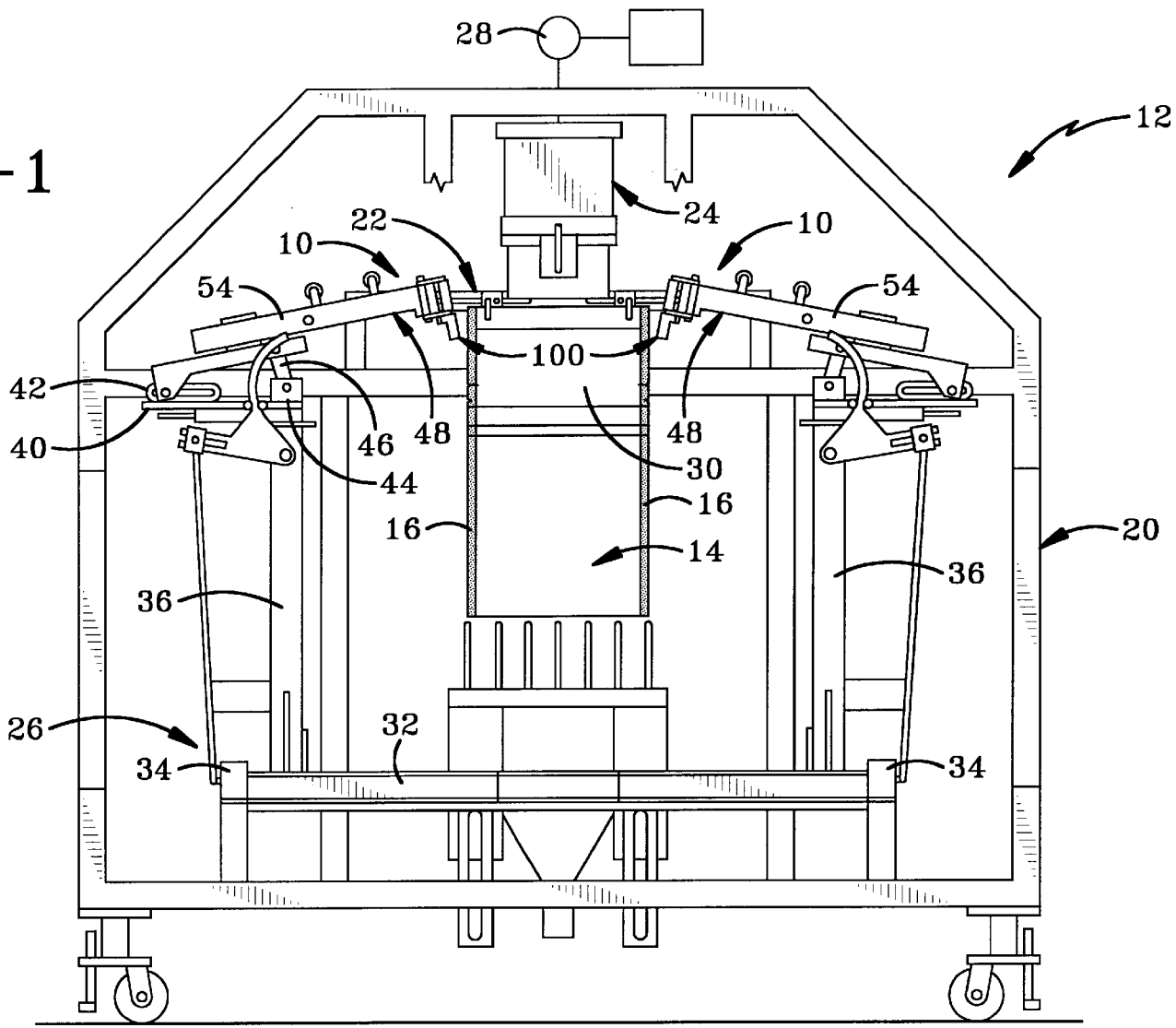
FIG. 1 is a front view of the first embodiment of a bag filling and sealing apparatus that incorporates the first embodiment of the flange alignment and grasping assemblies of the present invention.

The first embodiment of the flange alignment and grasping assemblies of the present invention are indicated generally by the numeral 10 in the accompanying drawings. Assemblies 10 are used with a first embodiment of a bag handling apparatus 12 that is adapted to fill and seal flexible bags 14. Each bag 14 has a pocket with longitudinal flanges 16 disposed along each side of the pocket. Assemblies 10 are adapted to guide flanges 16 into a position where they may be grasped by assemblies 10 so that bag 14 may be moved within bag handling apparatus 12.

First embodiment of bag handling apparatus 12 includes a frame 20, a bag holder 22, a funnel assembly 24, a grabber assembly 26, and a sealing station (not shown). Bag handling apparatus 10 is described for the purpose of providing an example and the best mode for the invention. The inventor contemplates that assemblies 10 may be used with other types of bag handling apparatus without falling outside of the scope of the claims; apparatus 12 being described to provide an example. Bag holder 22 holds a plurality of wicketed bags 14 in a ready position. Funnel assembly 24 is positioned above bags 14 and is operable to successively open each bag 14, tear bag 14 from bag holder 22, fill bag 14 with material, and release bag 14 to a grabber assembly 26. Grabber assembly 26 engages the sides of bag 14 while bag 14 is attached to funnel assembly 24 and later pulls the sides of bag 14 away from each other so that the top of bag 14 is closed and ready to seal when bag 14 is delivered to the sealing apparatus.

Apparatus 12 operates by taking an empty bag 14 from bag holder 22 and moving it to an open position with funnel assembly 24. Apparatus 12 first checks to be sure bag 14 is positioned on funnel assembly 24 and then delivers material from a material supply 28 (shown schematically in FIG. 1) through funnel assembly 24 and into bag 14. While this occurs, grabber assembly 26 moves into position to grasp flanges 16 of bag 14 so that the upper portion 30 of bag 14 may be pulled closed while loaded bag 14 is moved from the filling station to the sealing station.

Grabber assembly 26 includes a common drive rod 32 that is pivotally connected to frame 20 by a pair of bearing blocks 34. An appropriate actuator (not shown) is carried by frame 20 to rotate drive rod 32. Grabber arms 36 extend up from both ends of drive rod 32 to positions on either side of funnel assembly 24.

One flange alignment and grasping assembly 10 is mounted at the top of each arm 36. Each assembly 10 is configured to move inwardly in an arcing motion to grab flange 16 of bag 14. As such, each assembly 10 moves at least over (inwardly toward bag 14) and down with respect to bag 14 as it performs this motion. By moving inwardly and down with respect to bag 14, assembly 10 is able to move flange 16 to an extended position so that flange 16 may be clamped. These steps decrease the frequency of misses and increase the efficiency of bag handling apparatus 12.

Each flange alignment and grasping assembly 10 includes a base 40 upon which a stationary cam 42 and rotary actuator 44 are mounted. Stationary cam 42 is a fixed member having a longitudinal slot that is disposed substantially parallel to base 40. Rotary actuator 42 selectively rotates a drive arm 46 about a pivot axis. The outer end of drive arm 46 is connected to a hand assembly 48 that includes a first 50 and a second 52 jaw mounted to the inner end of a hand assembly base 54. Hand assembly 48 is pivotally connected to drive arm 46 and slidably connected to stationary cam 42 with a cam follower 56. Hand assembly 48 is thus moved in toward bag 14 by rotating drive arm 46 with rotary actuator 44 toward bag 14. Hand assembly 48 is moved away from bag 14 by rotating drive arm 46 with rotary actuator 44 away from bag 14. When drive arm 46 is rotated toward bag 14, hand assembly 48 simultaneously pivots and slides. This action moves hand assembly 46 inwardly and downwardly with respect to bag 14. When drive arm 46 is rotated away from bag 14, hand assembly 48 simultaneously pivots and slides. This action moves hand assembly 46 upwardly and outwardly with respect to bag 14.

Each jaw 50 and 52 includes an upper bracket 60 and a lower bracket 62. Each bracket 60 and 62 includes first 64 and second 66 arm portions that are connected together at an elbow 68. Each bracket 60 and 62 is pivotally connected to base 54 at elbow 68 to allow jaws 50 and 52 to pivot between open and closed positions. Each first arm portion 64 defines an opening 70 that may be in the form of a slot 70. First arm portions 64 are overlapped to align slots 70 as shown in FIG. 2. A pin 72 is positioned in at least two slots 70 (two upper or two lower) of two overlapped first arm portions 64. In another embodiment of the invention, pin 72 may extend through all four slots 70.

Figure 14:
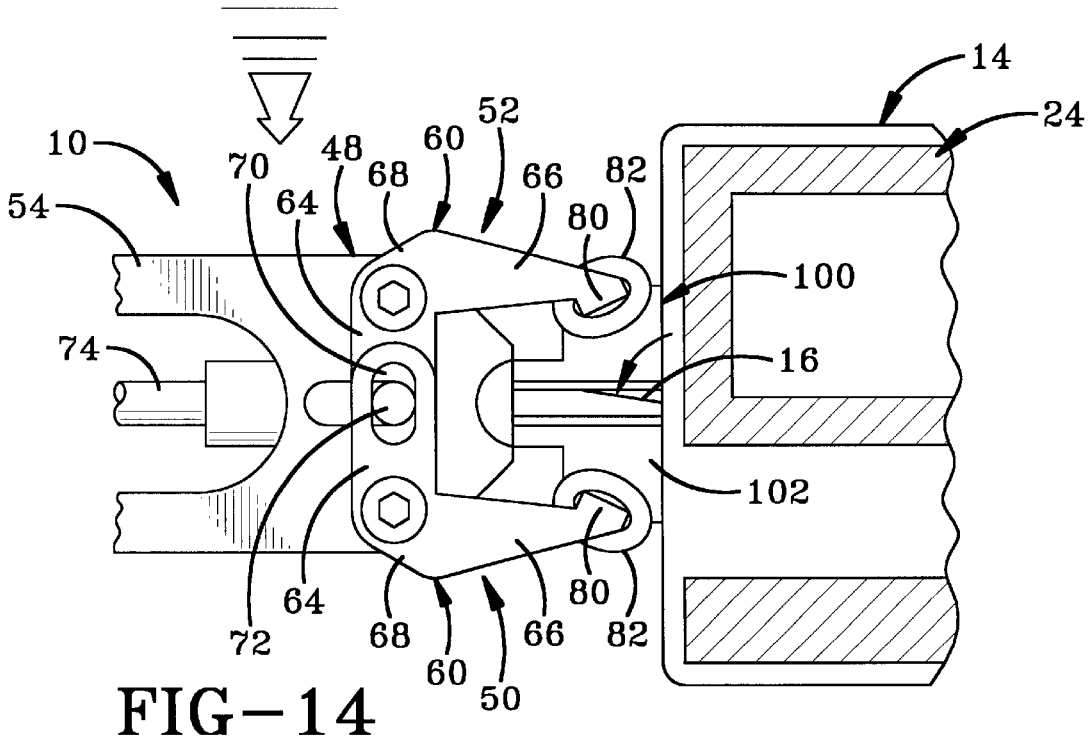
FIG. 14 is a view similar to FIG. 12 with the arm in the grasping position and the flange aligned by the assembly of the invention.
Figure 15:
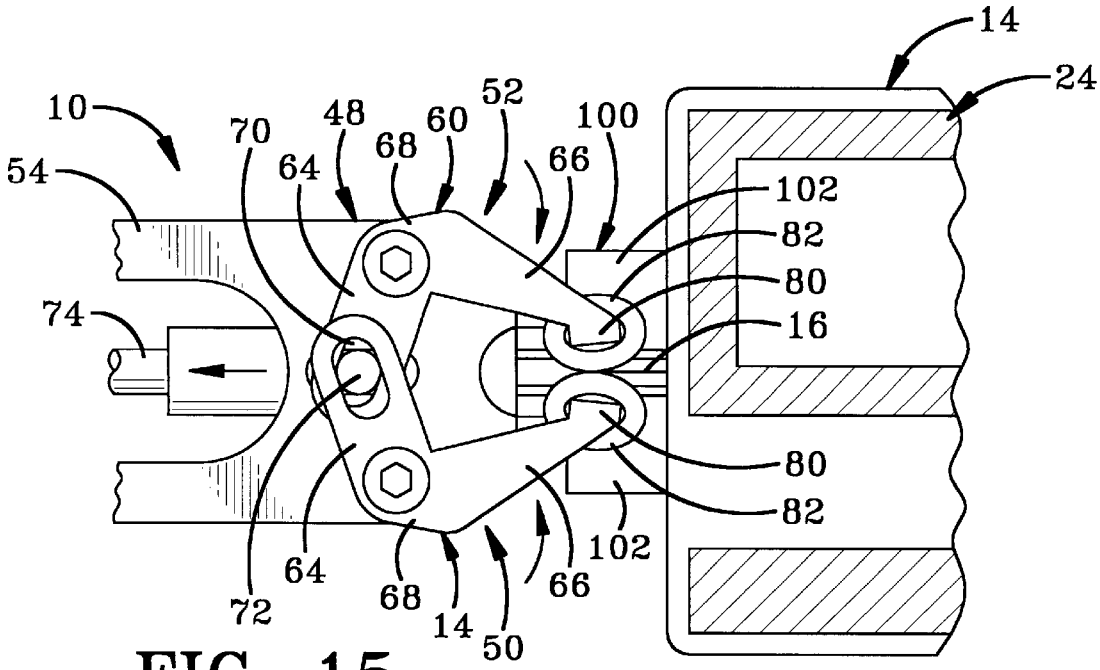
FIG. 15 is a view similar to FIG. 14 showing the assembly of the invention grasping the flange.

An actuator 74 is carried by base 54. Actuator 74 is connected to pin 72. Actuator 74 is adapted to move back and forth to drive pin 72 between first and second positions. When pin 72 is in the first position, jaws 50 and 52 are open as depicted in FIGS. 2 and 14. When pin 72 is pulled toward base 54 in the second position, jaws 50 and 52 are moved to the closed position as shown in FIG. 15.

A support 80 extends between the outer ends of second arm portions 66 of each jaw 50 and 52. Supports 80 are adapted to engage flange 16 of bag 14 and may be textured to create friction between support 80 and flange 16. Supports 80 may be substantially parallel or may be curved or angled. The longitudinal direction of support 80 is also the longitudinal direction of jaws 50 and 52. A tube 82 is disposed around each support 80. Tubes 82 are fabricated from a material that creates a large frictional force against the material of bag 14. Exemplary materials are plastic and rubber. Tubes 82 are forced together tightly when jaws 50 and 52 are in the closed position. This position allows flange 16 to be tightly held by jaws 50 and 52.

Other types of jaws may also be used with the present invention without departing from the concepts of the invention. For instance, each jaw may include pinchers, clamps, or extending fingers that cooperate together to hold the flange of the bag. Jaws may also be fabricated from material that creates a large friction force with the material of bag so that tubes 82 do not have to be used. Supports 80 may be roughened or may include teeth that provide good gripping properties.

Figure 12:
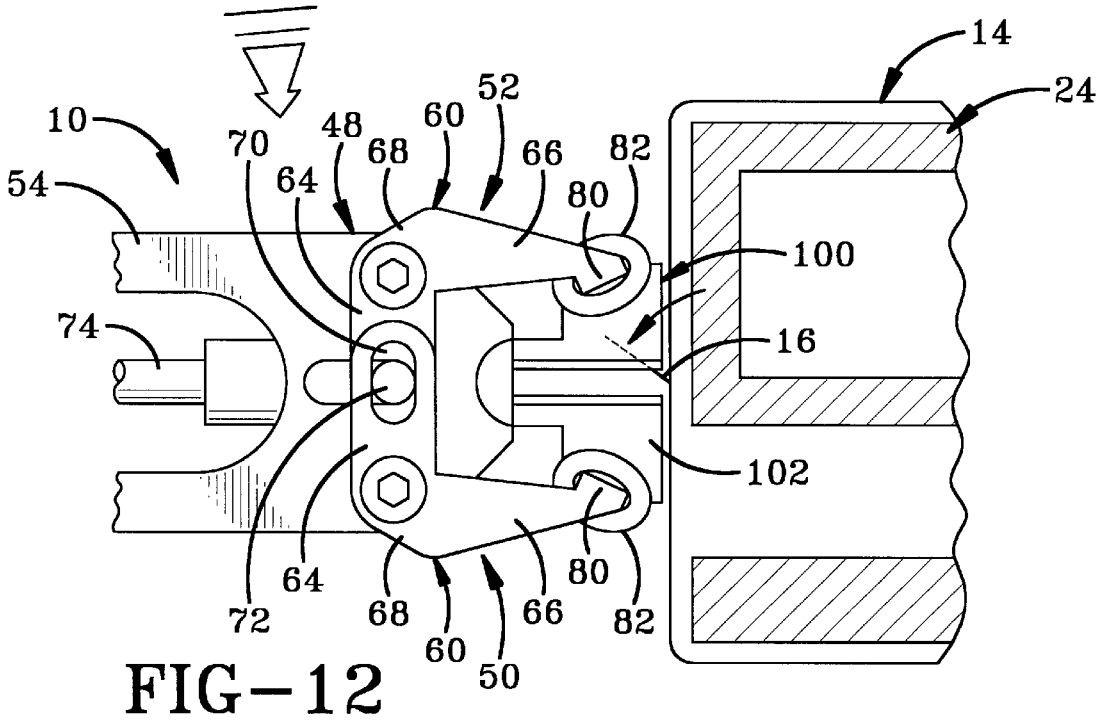
FIG. 12 is a view similar to FIG. 11 showing the assembly being lower with respect to the flange.

Jaws 50 and 52 define upper ends and lowers ends. In the embodiment of the invention depicted in FIG. 4, the upper ends of jaws 50 and 52 are disposed adjacent upper brackets 60 while the lower ends of jaws 50 and 52 are disposed adjacent lower brackets 62. The lower ends of jaws 50 and 52 are thus the leading end of the jaws and the leading end of hand assembly 48. In this embodiment, a guide 100 is positioned adjacent the leading end of jaws 50 and 52. Guide 100 is configured to engage flange 16 when hand assembly 48 is moved toward bag 14 in order to move flange 16 to an extended position so that flange 16 may be grasped by jaws 50 and 52. In the context of the present application, the term "to move" is intended to mean that flange 16 is urged outwardly from a collapsed position against bag 14 (FIGS. 8 and 12) to an extended position (FIGS. 6 and 14) or that the position of flange 16 is maintained by guide 100. In some situations, flange 16 will already be extended when guide 100 arrives beside bag 14, In this situation, the extended position of flange 16 is maintained or slightly improved by guide 100. This action will be referred to herein as "moving" the flange to the extended position.

Guide 100 includes first and second opposed guide plates 102. Guide plates 102 each having a leading end and a following end. The following end of each guide plate 102 is disposed adjacent the leading end of jaws 50 and 52. The leading end of guide plates 102 is adapted to engage flange 16 of bag 14 before jaws 50 and 52. As shown in FIGS. 4, 25, 27, and 29, guide plates 102 converge from the leading end toward the following end. As such, the distance between the leading ends is greater than the distance between the following ends. This arrangement allows guide plates 102 to gather flange 16 and position flange 16 between plates 102 regardless of the position of flange 16 with respect to bag 14.

Figure 25:
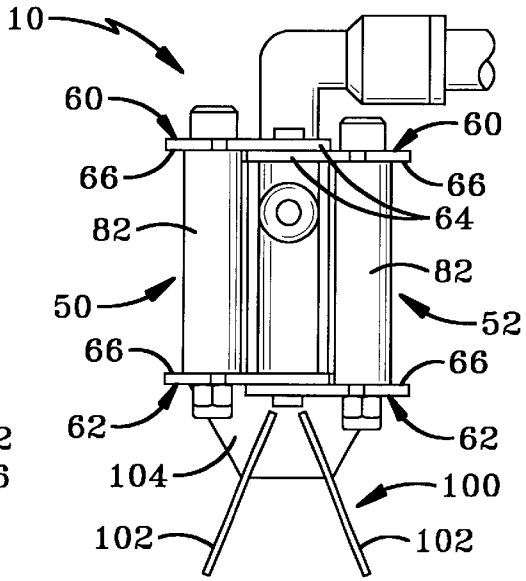
FIG. 25 is an end view of FIG. 24.
Figure 24:
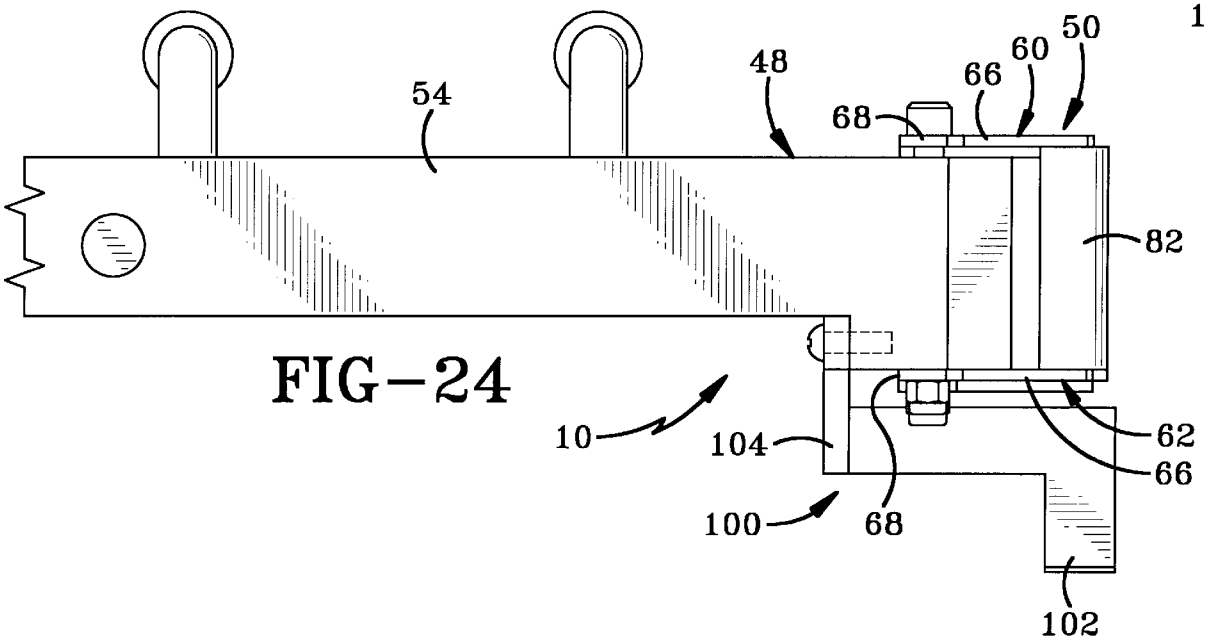
FIG. 24 is a view similar to FIG. 3 showing the third embodiment of the alignment and grasping assembly of the invention.
Figure 27:
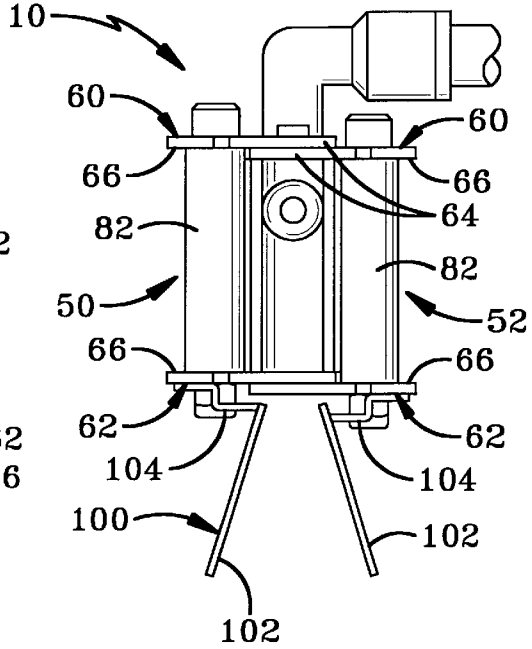
FIG. 27 is an end view of FIG. 26.
Figure 26:
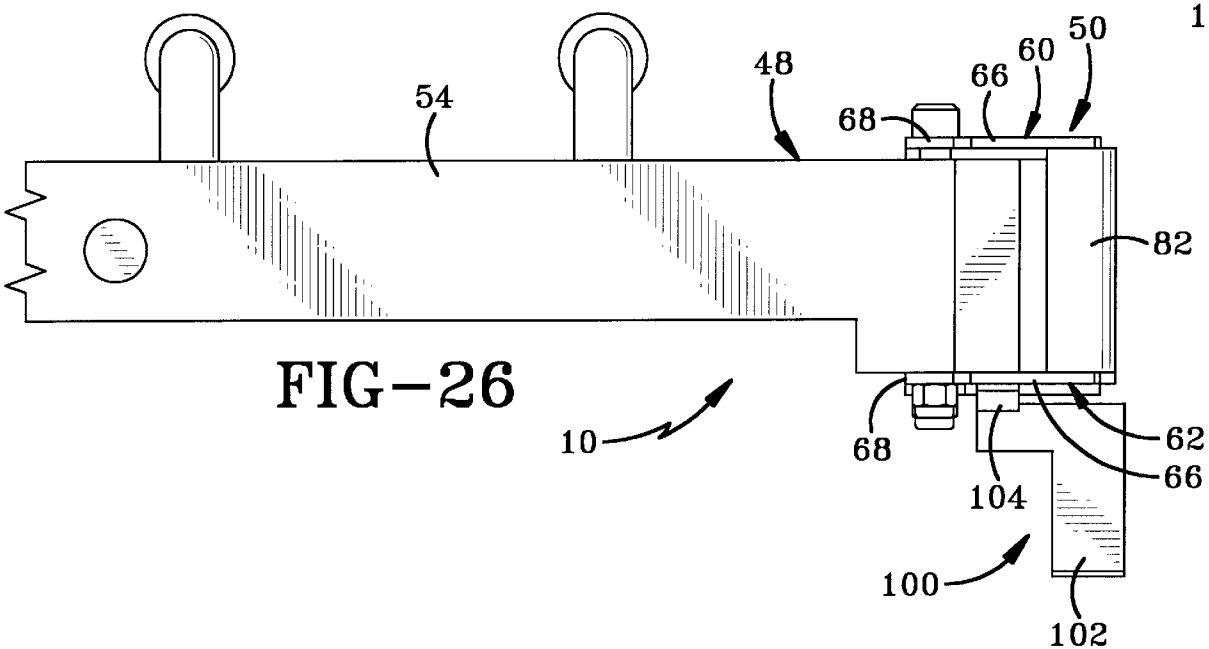
FIG. 26 is a view similar to FIG. 3 showing the fourth embodiment of the alignment and grasping assembly of the invention.
Figure 29:
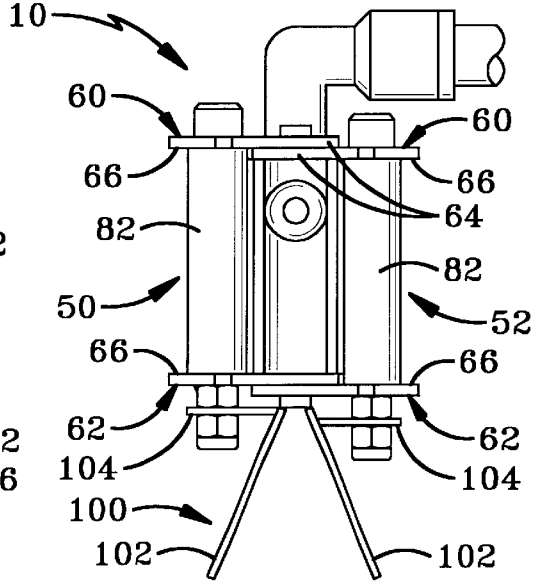
FIG. 29 is an end view of FIG. 28.
Figure 28:
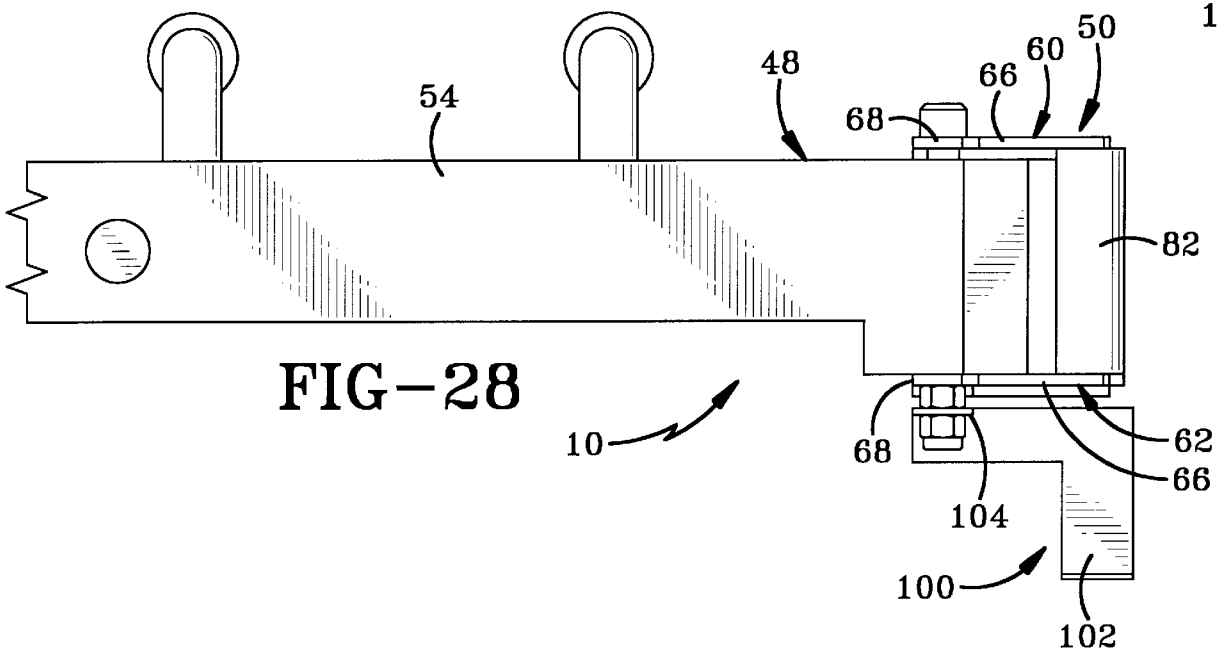
FIG. 28 is a view similar to FIG. 3 showing the fifth embodiment of the alignment and grasping assembly of the invention.
Figure 30:
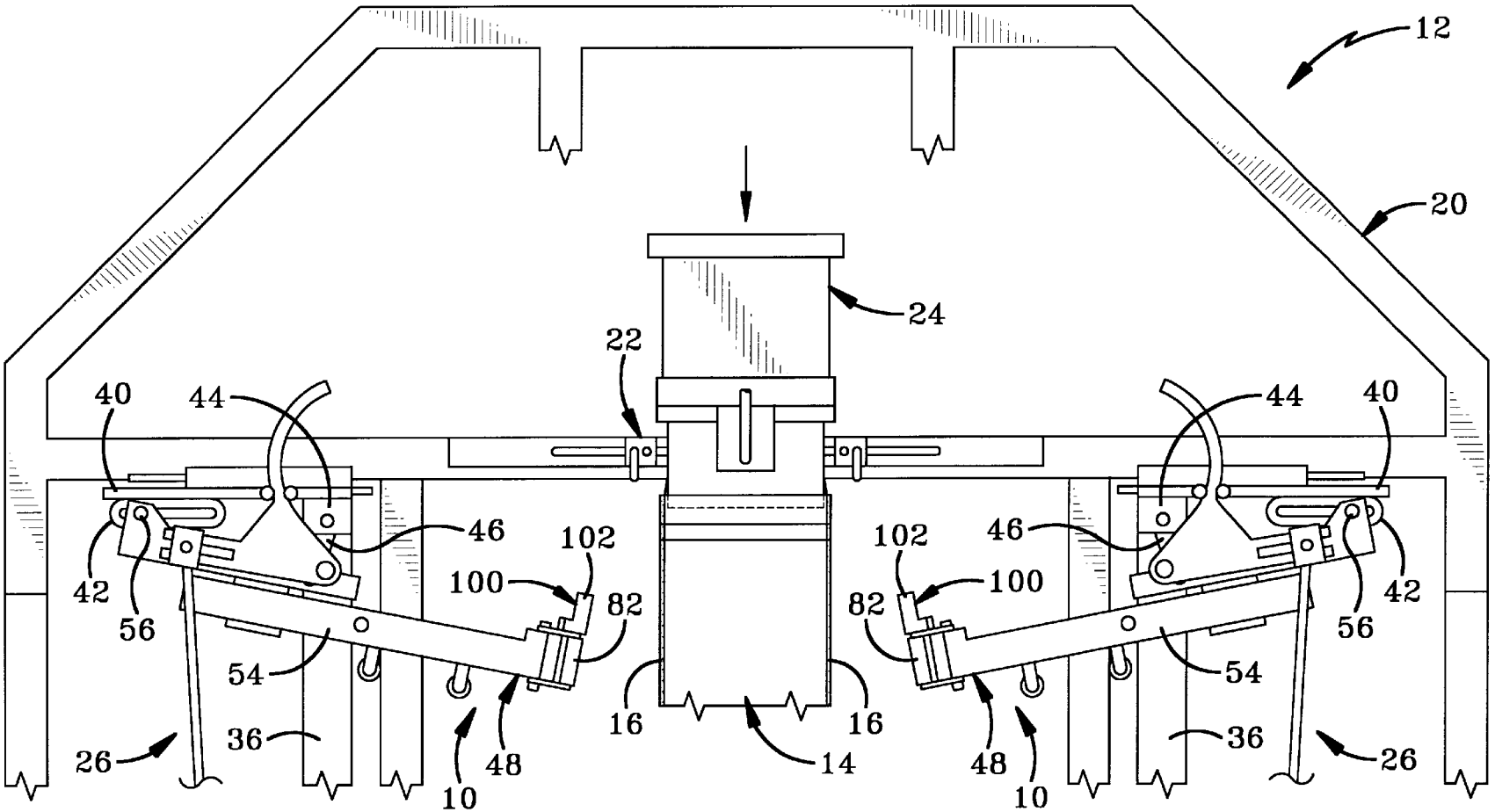
FIG. 30 is a front view of the second embodiment of a bag filling and sealing apparatus that incorporates the first embodiment of the flange alignment and grasping assemblies of the present invention.

Guide plates 102 may be connected to hand assembly 48 in any of a variety of methods with examples shown in FIGS. 3, 4, 24, 25, 26, 27, 28, and 29. In FIGS. 3 and 4, plates 102 are connected to a base support 104 that is connected to the inner end of base 54 of hand assembly 48. In FIGS. 24 and 25, base support 104 is L-shaped and is connected to base 54 in back of jaws 50 and 52. In FIGS. 26 and 27, each guide plate 102 has its own base support 104 which connects guide plate 102 to jaw 50 or 52. In FIGS. 28 and 29, each guide plate 102 has its own L-shaped base support 104 that is connected to base 54 behind jaws 50 and 52. In the embodiments of FIGS. 3, 4, 24, and 25, guide plates 102 move with base 54 but jaws 50 and 52 open and close independent of guide 100. In the embodiments of FIGS. 26–29, guide plates 102 open and close with jaws 50 and 52 between the open and closed positions.

Figure 5:
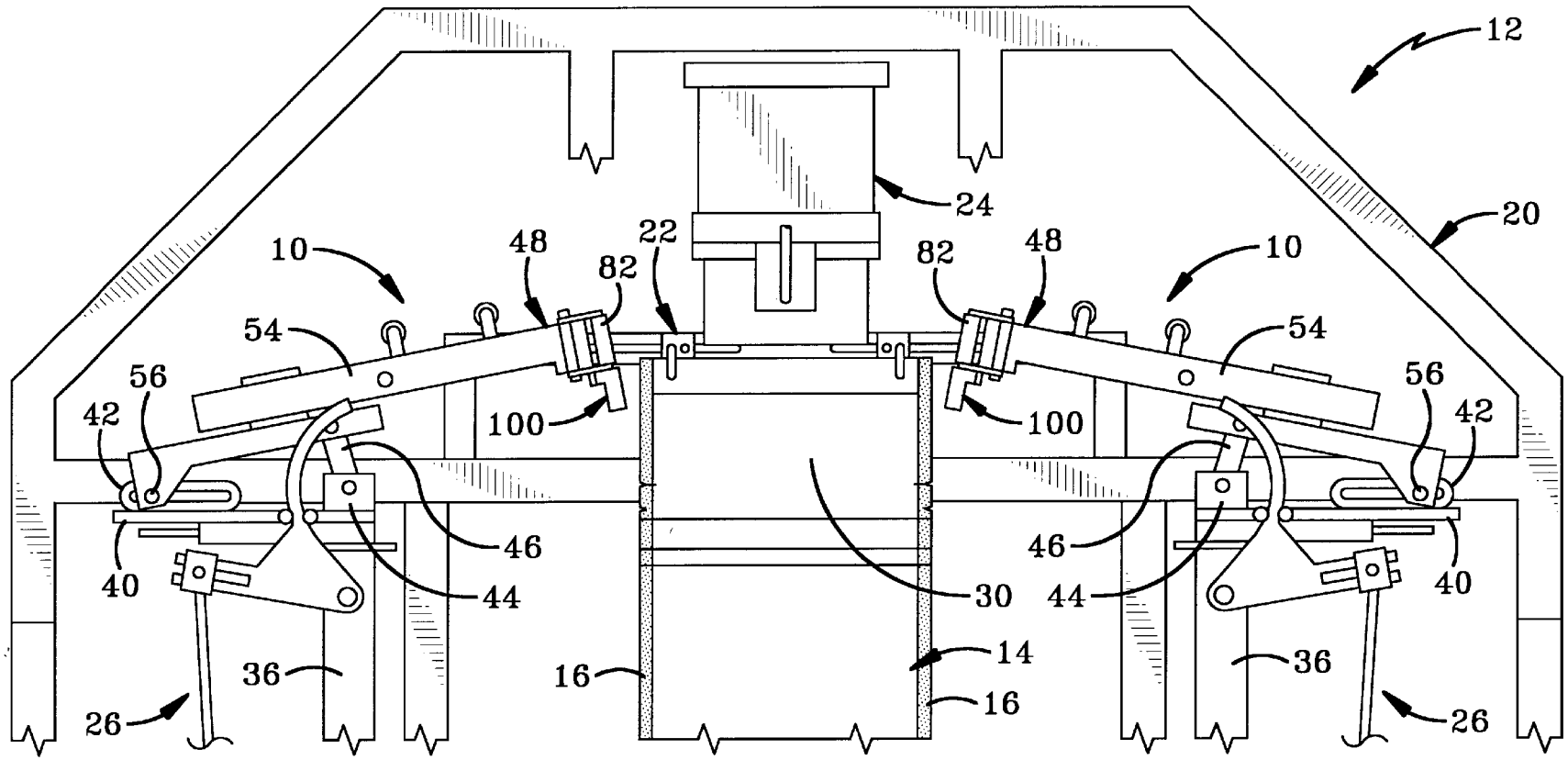
FIG. 5 is a front view of a portion of the apparatus of FIG. 1 with a bag positioned to be grasped by the arms.
Figure 6:
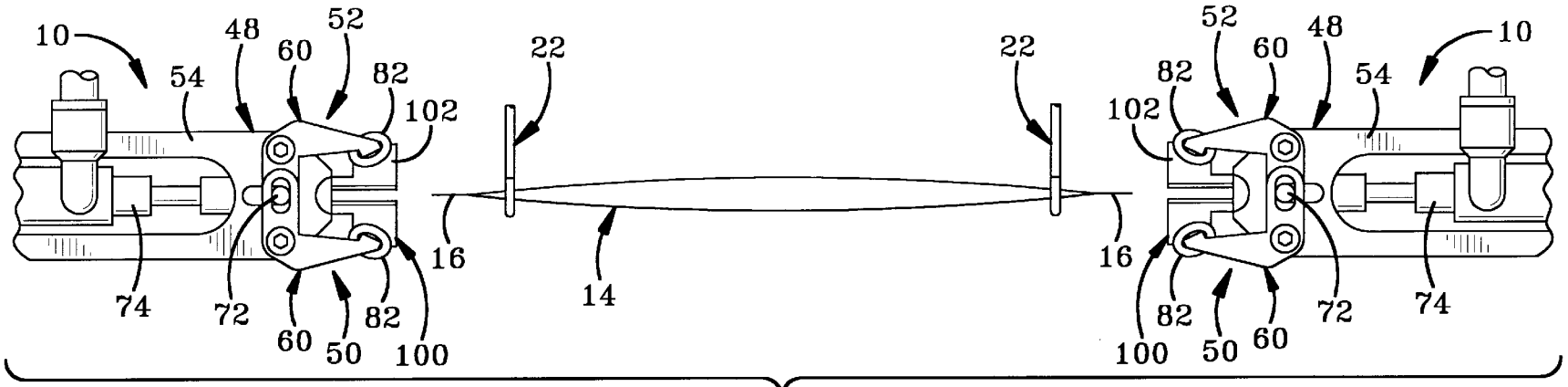
FIG. 6 is a top view of the arms and bag in the initial position depicted in FIG. 5.
Figure 8:
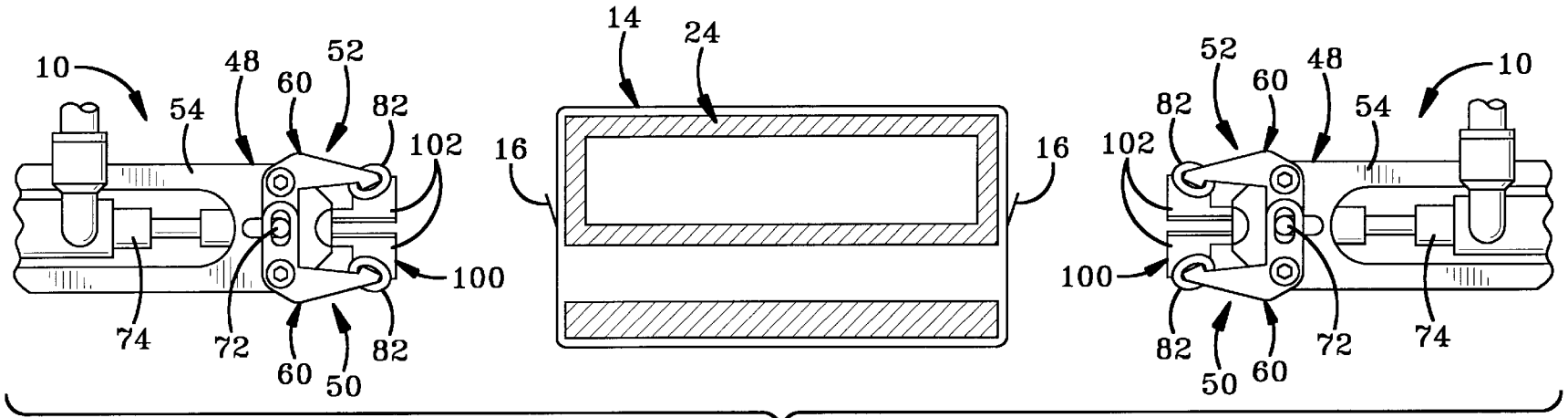
FIG. 8 is a top view, partially in section, looking down through the filling funnel into the bag.
Figure 7:
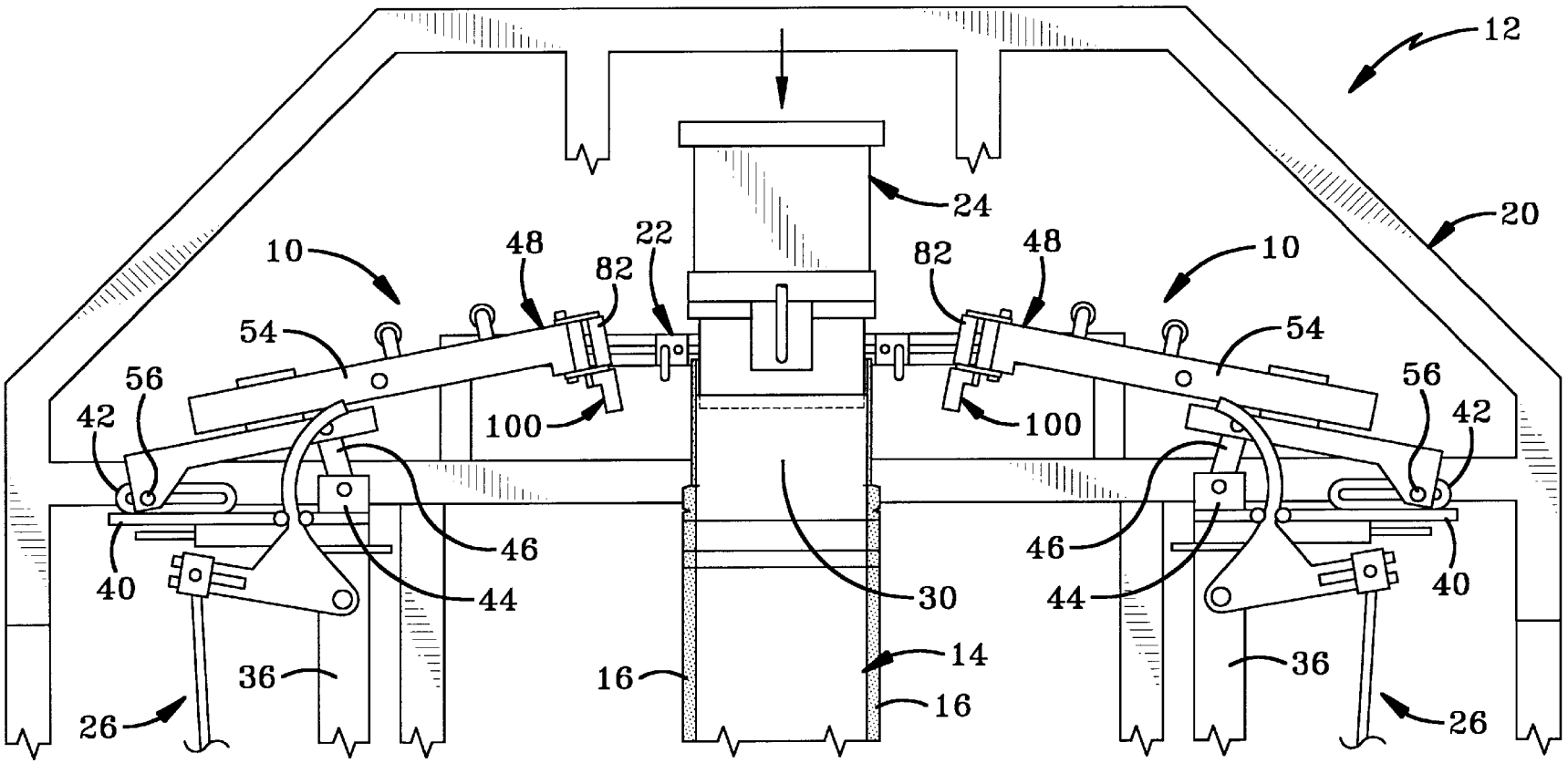
FIG. 7 shows the bag being filled with material.
Figure 9:
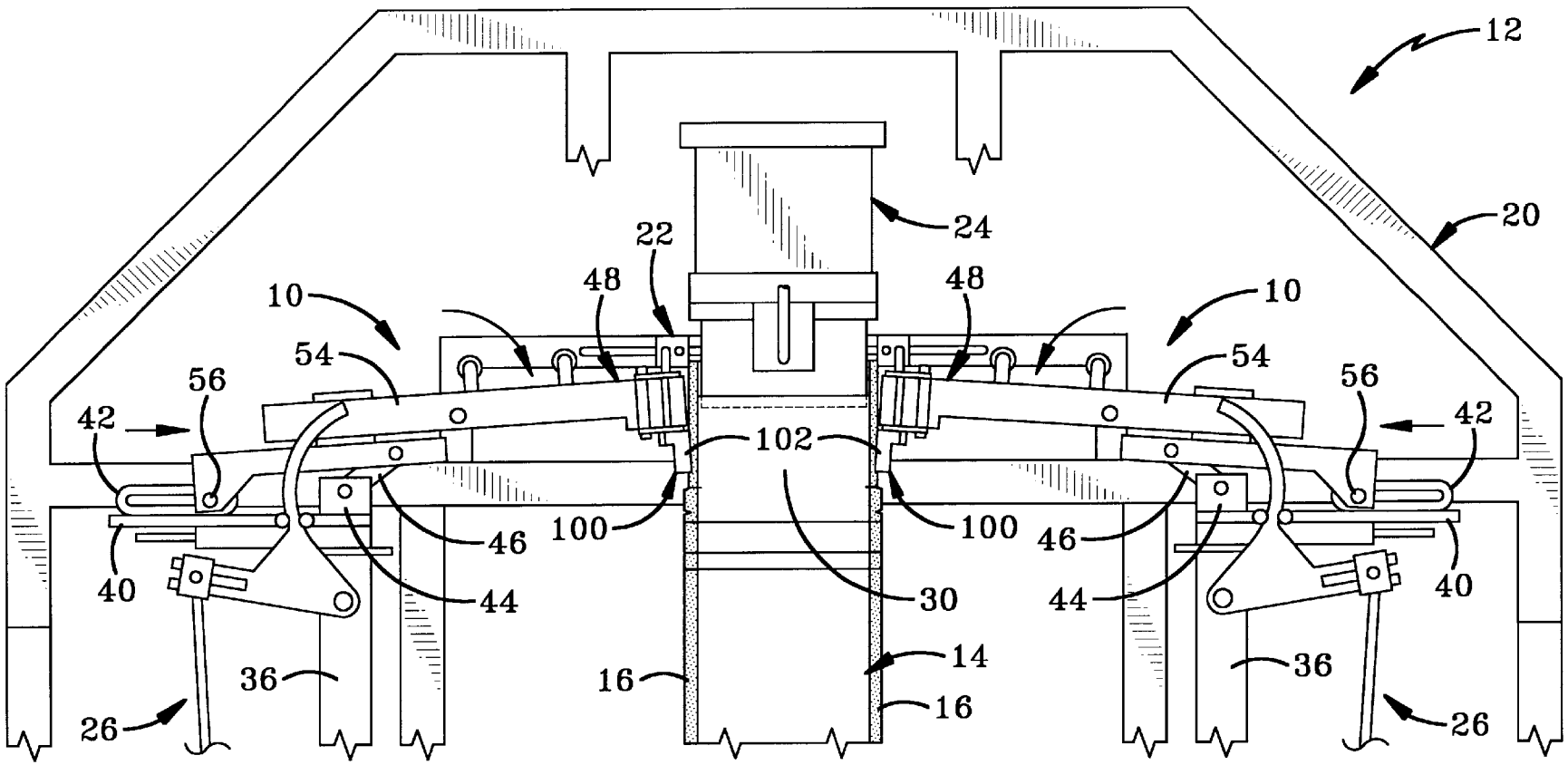
FIG. 9 is a front view showing the arms and flange alignment and grasping assemblies of the invention being moved down and inwardly onto the flanges of the bag.
Figure 10:
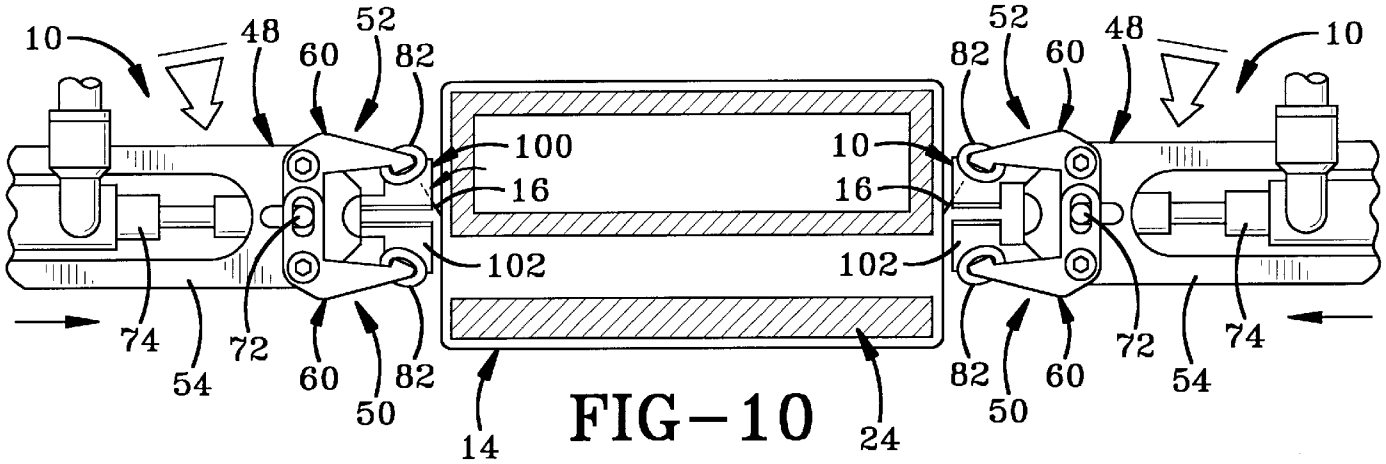
FIG. 10 is a top view of FIG. 9.
Figure 11:
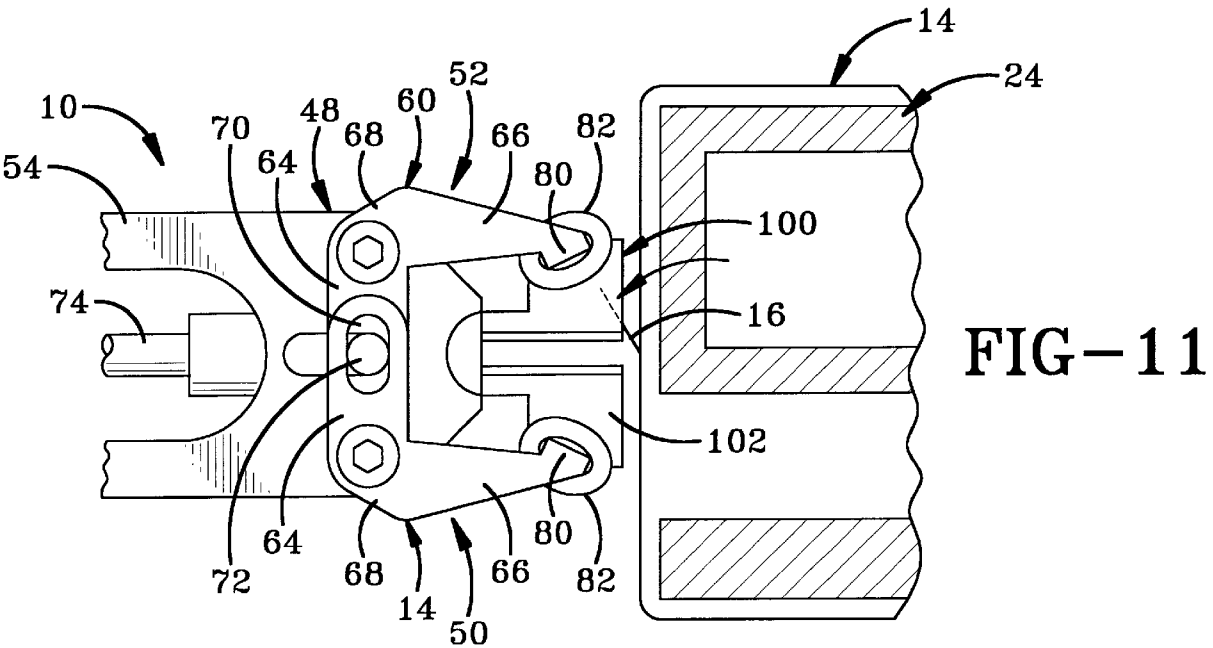
FIG. 11 is an enlarged top view showing one of the flange alignment and grasping assemblies of the invention initially engaging the flange of the bag.
Figure 13:
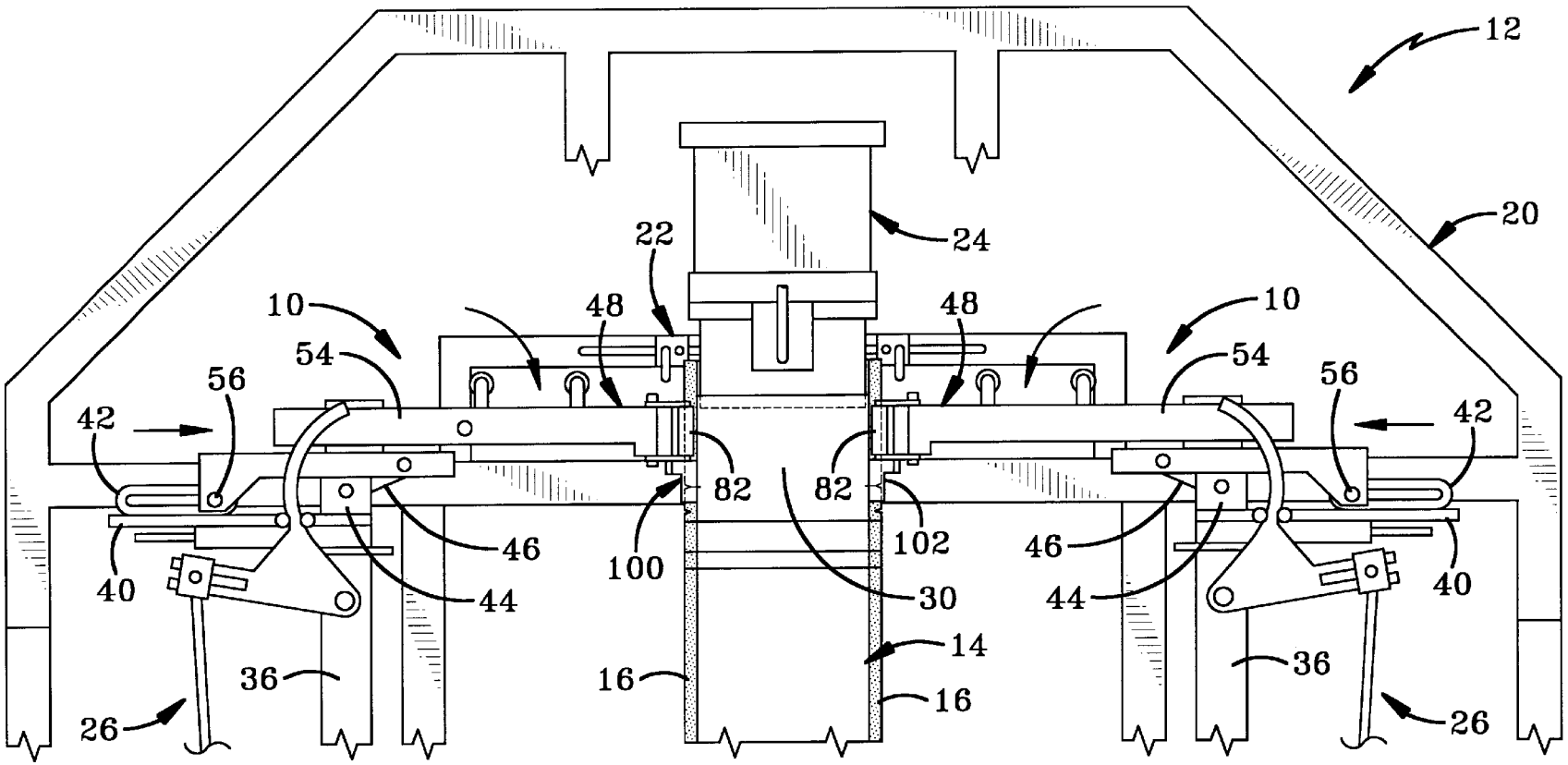
FIG. 13 is a front view showing the arms moved down and in to the grasping position.

The operation of guide 100 is depicted in FIGS. 5–19. In FIG. 5, bag 14 is held by bag holder 22 with funnel assembly 24 in its initial position. Flange alignment and grasping assemblies 10 are also disposed in their ready position. FIG. 6 is a top view of the apparatus of FIG. 5 showing flanges 16 in extended positions. In FIG. 7, funnel assembly 24 has moved into the top of bag 14 and opens bag 14 as depicted in FIG. 8. When this occurs, flanges 16 are typically pulled back against bag 14 to a collapsed position that may be fully collapsed or partially collapsed. Funnel assembly 24 is used to fill bag 14. Flange alignment and grasping assemblies 10 are then moved inwardly and downwardly with respect to bag 14 as depicted in FIG. 9. FIG. 9 shows that the upper portion of flanges 16 are in the collapsed position with respect to bag 14. Guides 100 are positioned at the leading end of jaws 50 and 52 so that guide 100 interacts with each flange 16 before jaws 50 and 52 are brought into the grasping position. The initial interaction is depicted in FIGS. 10 and 11 wherein the collapsed flange is initially disposed between the leading ends of guide plates 102. As each hand assembly 48 is moved downwardly with respect to flange 16 as depicted in FIGS. 11–14, guide plates 102 move flange 16 from the collapsed position to the extended position. The extended position is depicted in FIGS. 13 and 14. At this point, actuator 74 is used to move jaws from the open position depicted in FIG. 14 to the closed position depicted in FIG. 15. Jaws 50 and 52 clamp on flange 16 because flange 16 is in the extended position directly between jaws 50 and 52.

Figure 17:
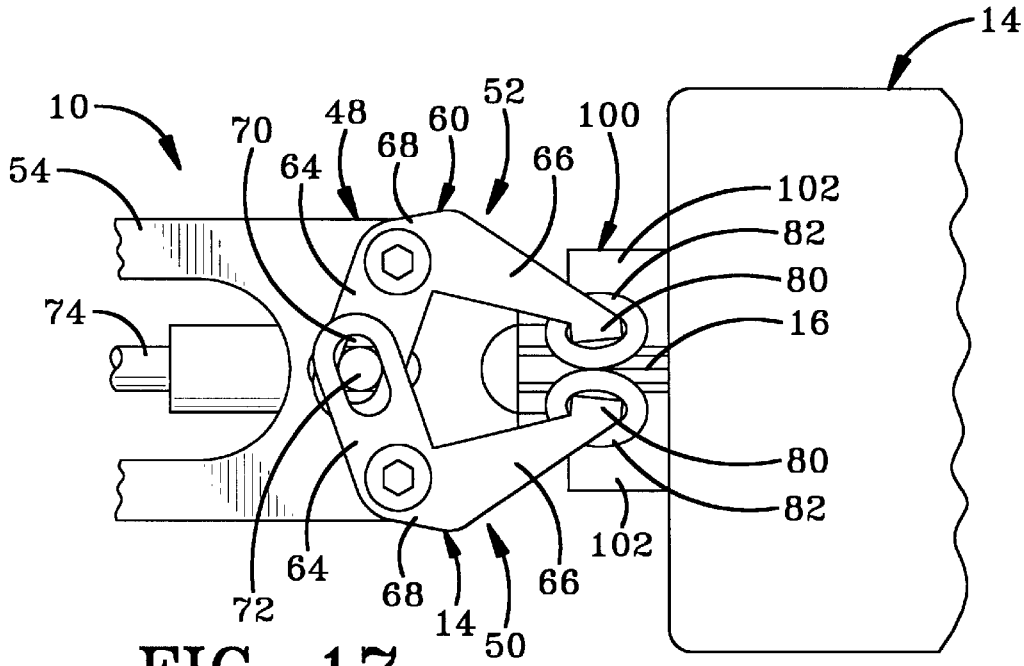
FIG. 17 is a view similar to FIG. 15 showing the bag being held by the grasping assembly of the invention.
Figure 16:
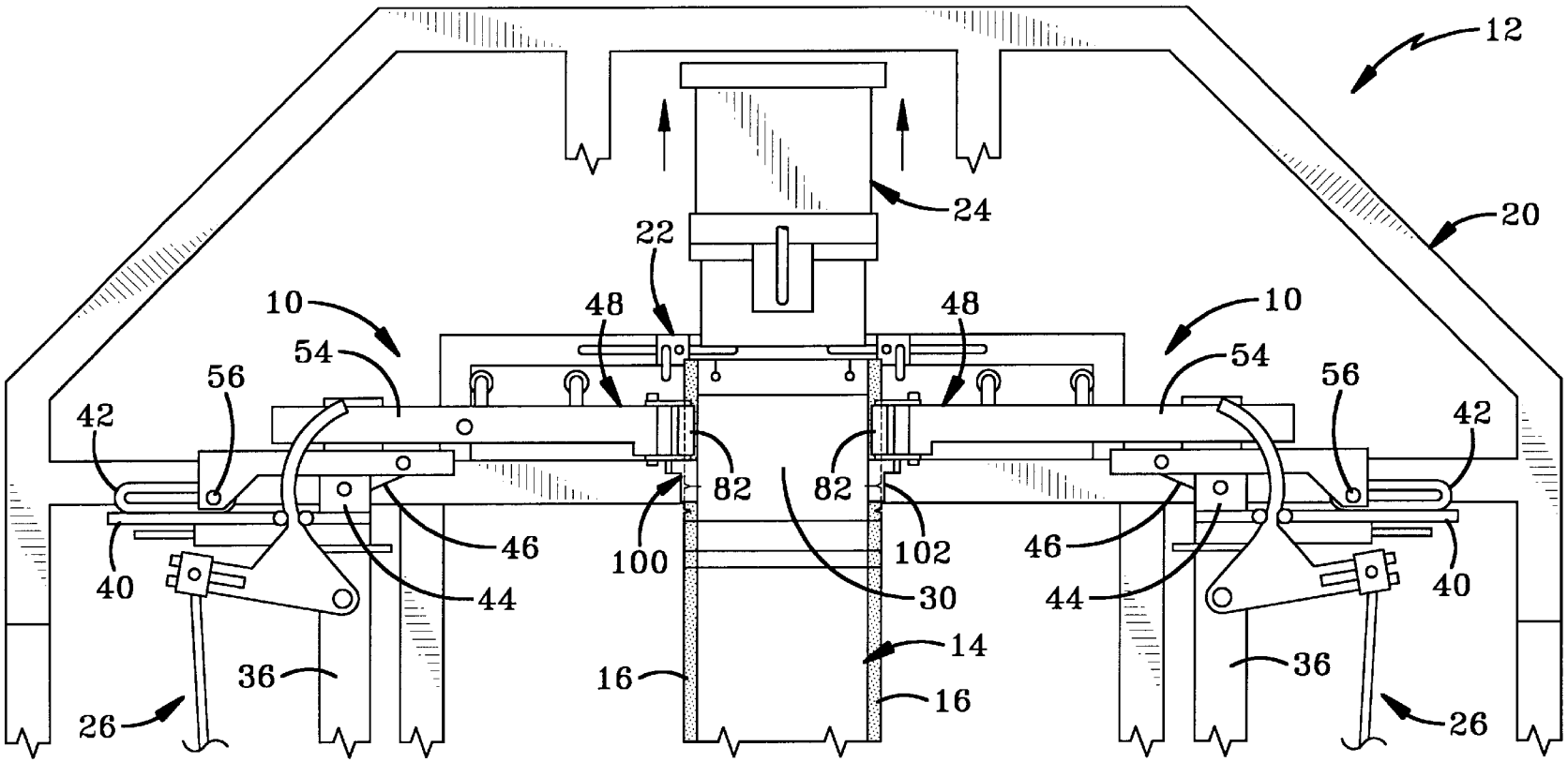
FIG. 16 is a front view showing the funnel being removed from the bag.
Figure 18:
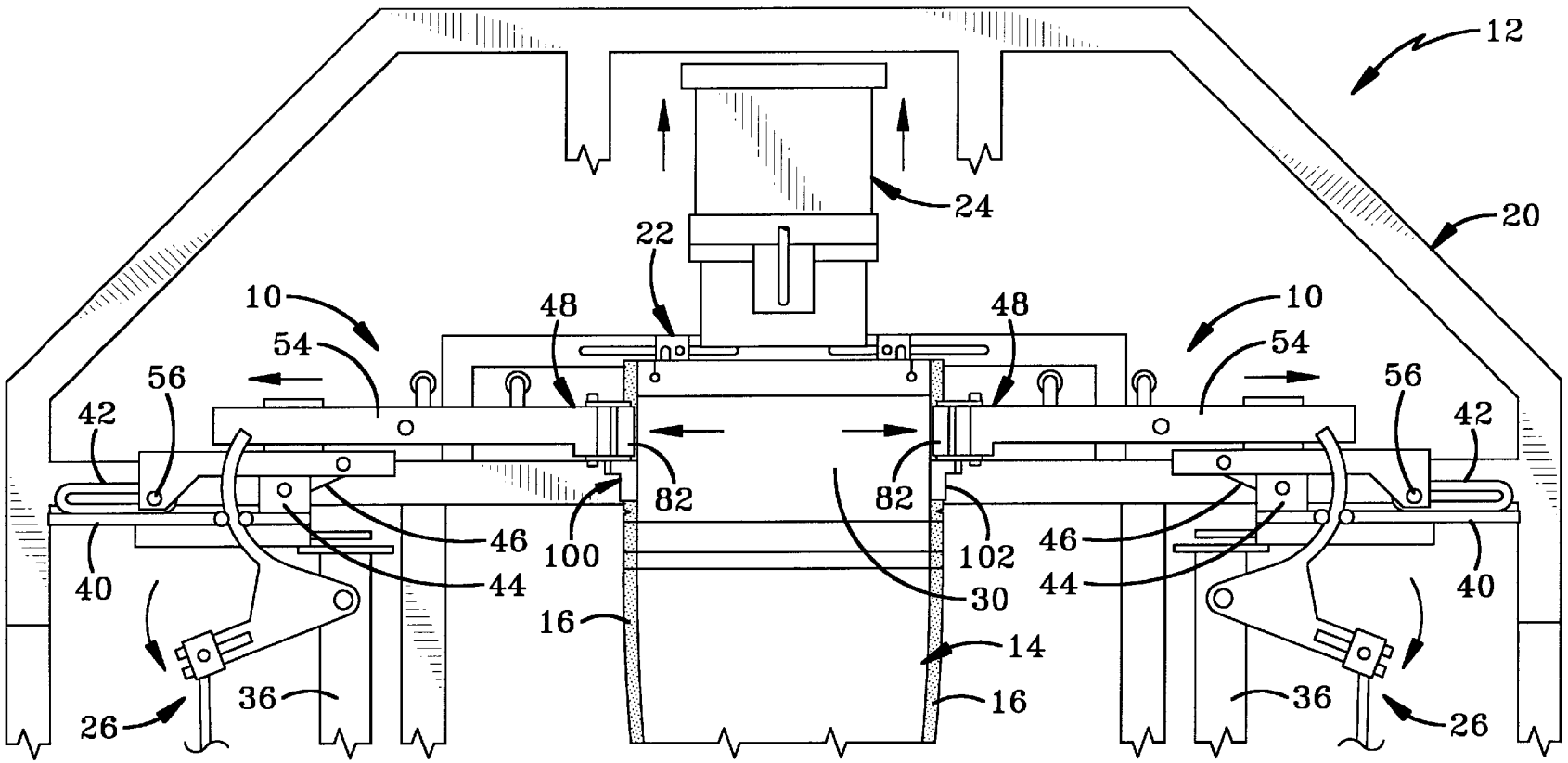
FIG. 18 is a front view showing the arms pulling outward to tighten the top of the bag so that it may be sealed.
Figure 19:
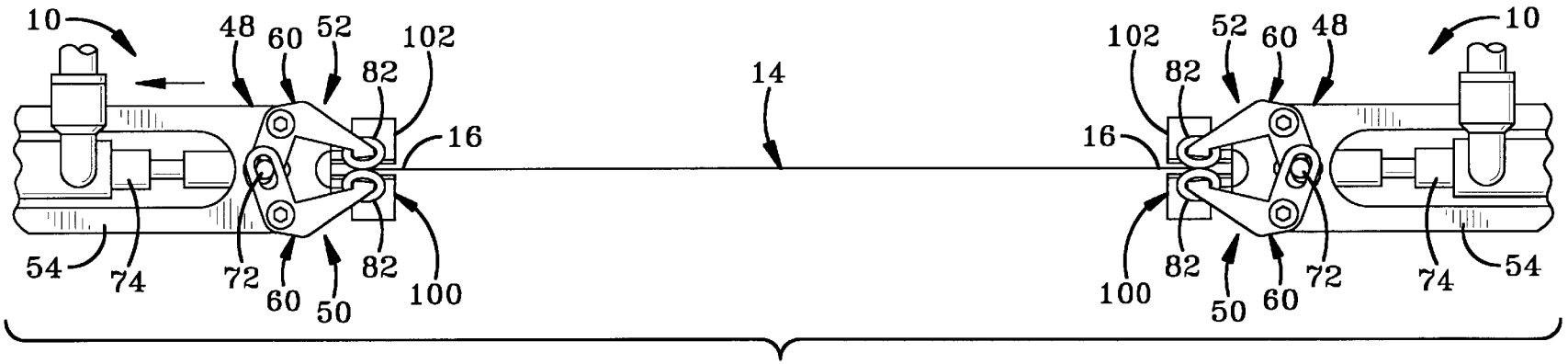
FIG. 19 is a top view of the bag being pulled tight by the arms.
Figure 20:
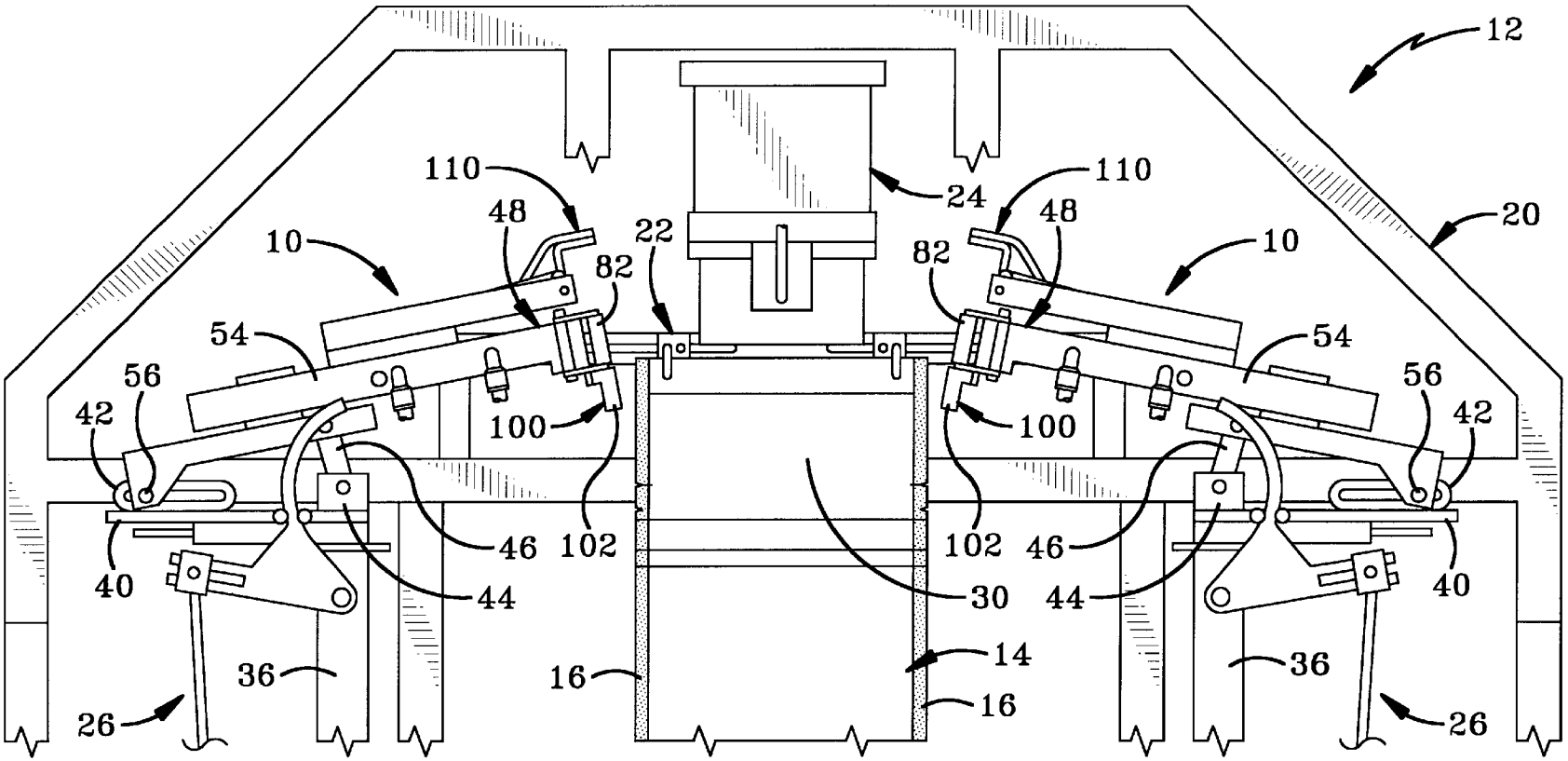
FIG. 20 is a view similar to FIG. 2 showing the second embodiment of the flange alignment and grasping assembly of the present invention.

Funnel assembly 24 is then removed as depicted in FIGS. 16 and 17 with bag 14 being held by hand assemblies 48 through the engagement of jaws 50, 52, and flange 16. Flange alignment and grasping assemblies 10 then pull flanges outwardly as depicted in FIGS. 18 and 19 so that the top of bag 14 may be tightened and smoothed so that it may be sealed. Bag 14 is then moved to the sealing station. The assemblies then return to their initial positions where the process is repeated.

In general, the invention thus provides a method for grasping a flange on a bag in a bag handling apparatus wherein a grasping arm 10 is moved from a resting position toward a bag 14 having a flange 16. Grasping arm 10 has a guide 100 that moves flange 16 to an extended position. Flange 16 is then grasped with jaws 50 and 52 so that bag 14 may be held by grasping arm 10. In order for guide 100 to work, guide 100 should engage flange 16 before jaws 50 and 52 arrive. This is accomplished by moving grasping arm 10 in an arch that moves inwardly and downwardly with respect to bag. As such, guide 100 is moved inwardly and downwardly with respect to bag 14. As described below in an alternative embodiment of the invention, the method may also be accomplished by moving the arm inwardly and upwardly with respect to bag 14.

Figure 21:
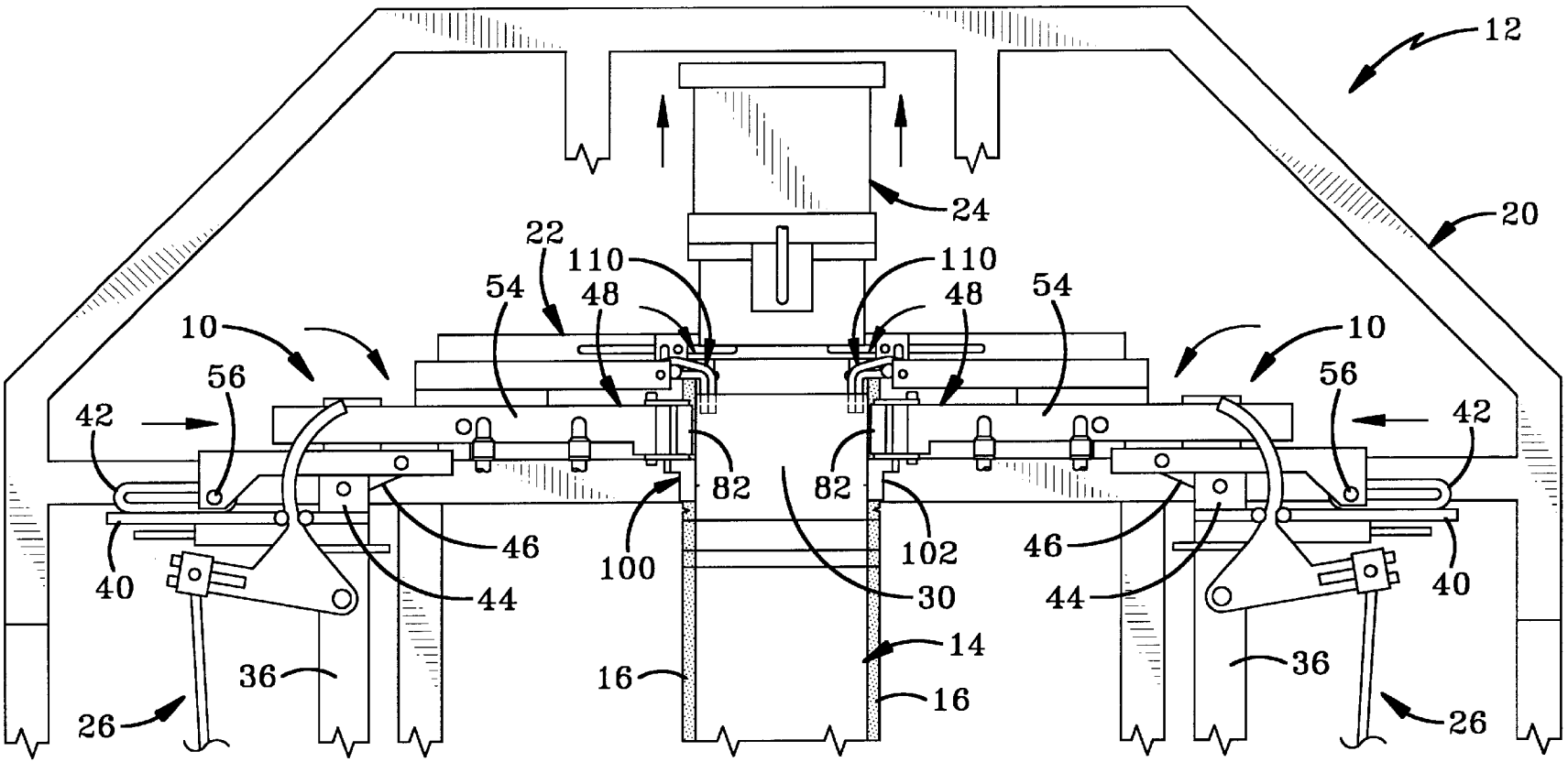
FIG. 21 shows the second embodiment of the invention grasping the bag with the vacuum tubes inserted into the top of the bag.
Figure 22:
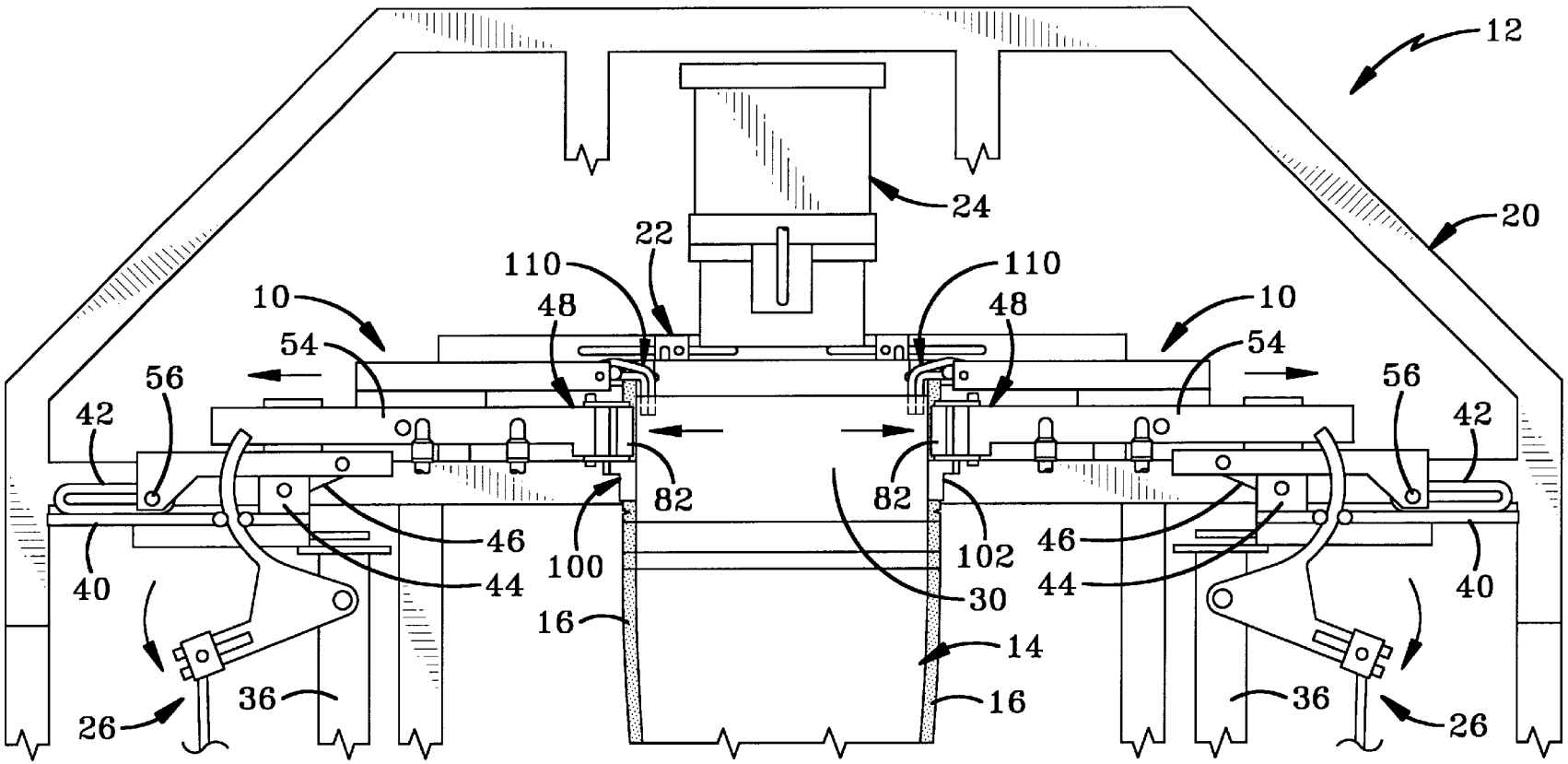
FIG. 22 shows the bag being pulled tight.
Figure 23:
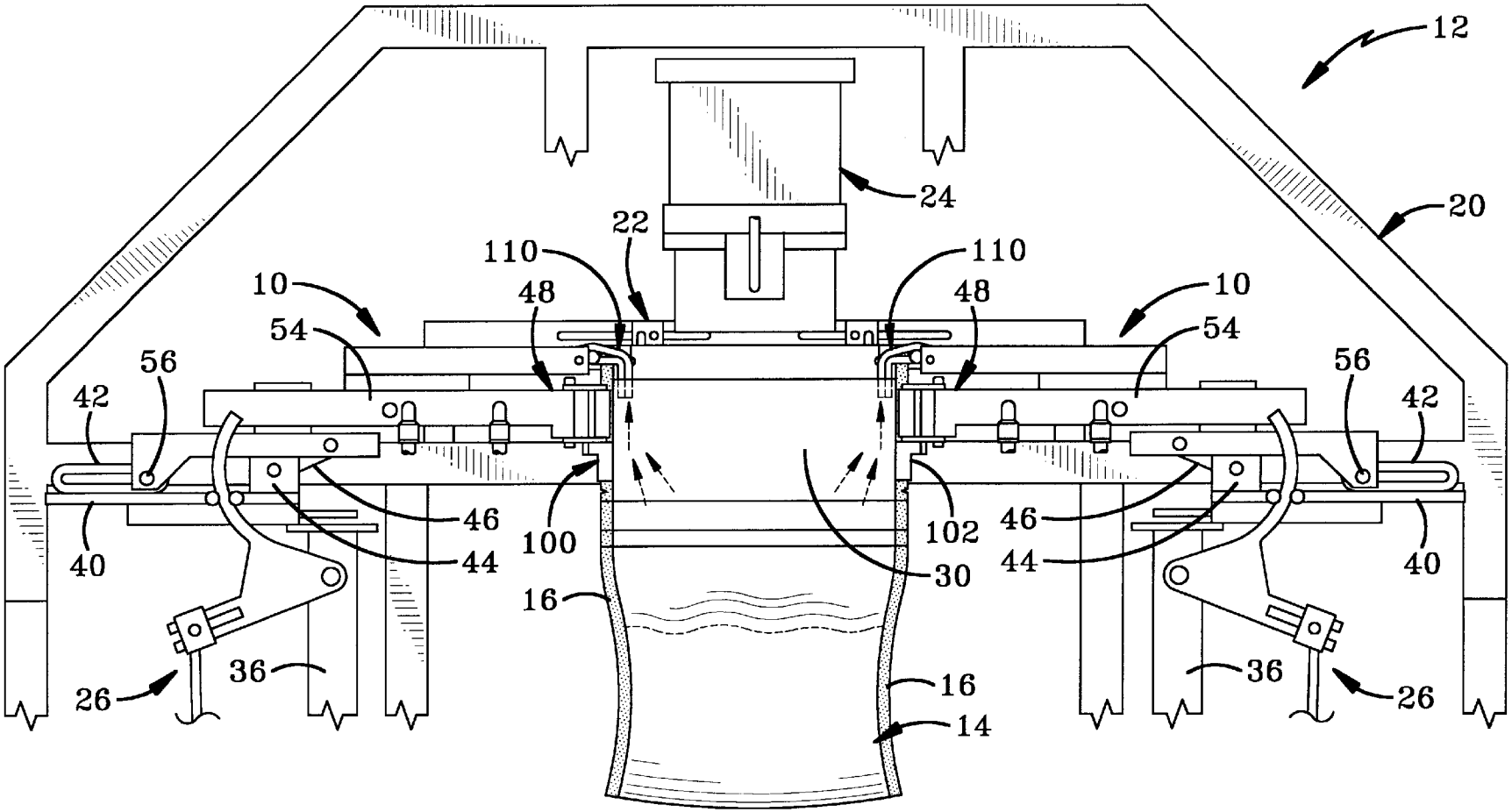
FIG. 23 shows a vacuum being drawn.

An alternative embodiment of the invention is depicted in FIGS. 20–23 wherein each hand assembly 48 includes a vacuum finger 110 that is pivotly mounted with respect to base 54 of hand assembly 48. Each vacuum finger 110 is connected to a vacuum source (not shown) that may be selectively turned on and turned off to draw a vacuum in bag 14 before bag 14 is sealed. FIG. 21 shows the operational position of vacuum finger 110 with FIG. 23 showing the vacuum source turned on to draw a vacuum in bag 14 through vacuum fingers 110.

Figure 31:
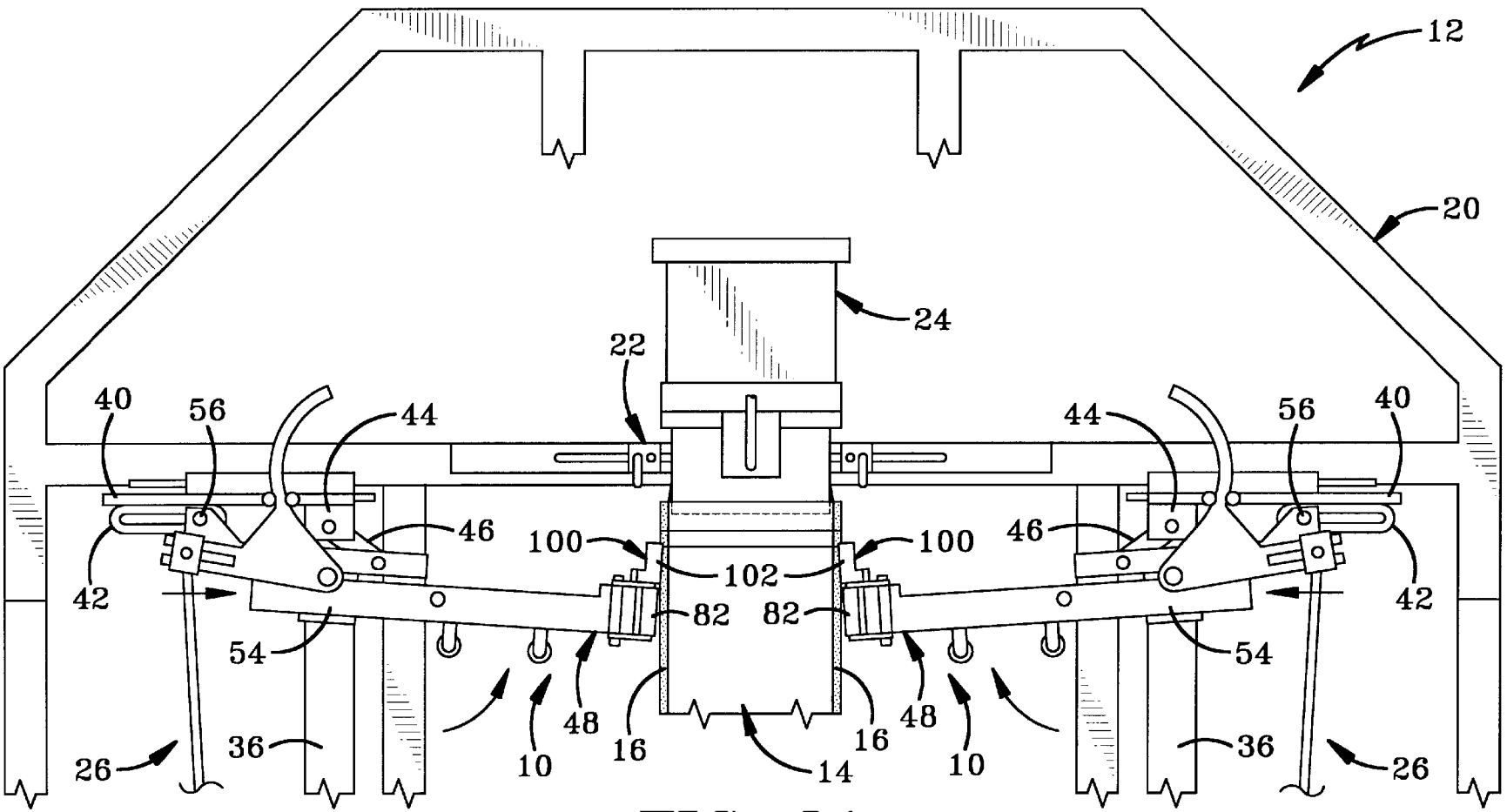
FIG. 31 is a front view of the arms of the second embodiment of the apparatus swinging inwardly and upwardly to engage the bag with the alignment and grasping assembly engaging the flange of the bag.
Figure 32:
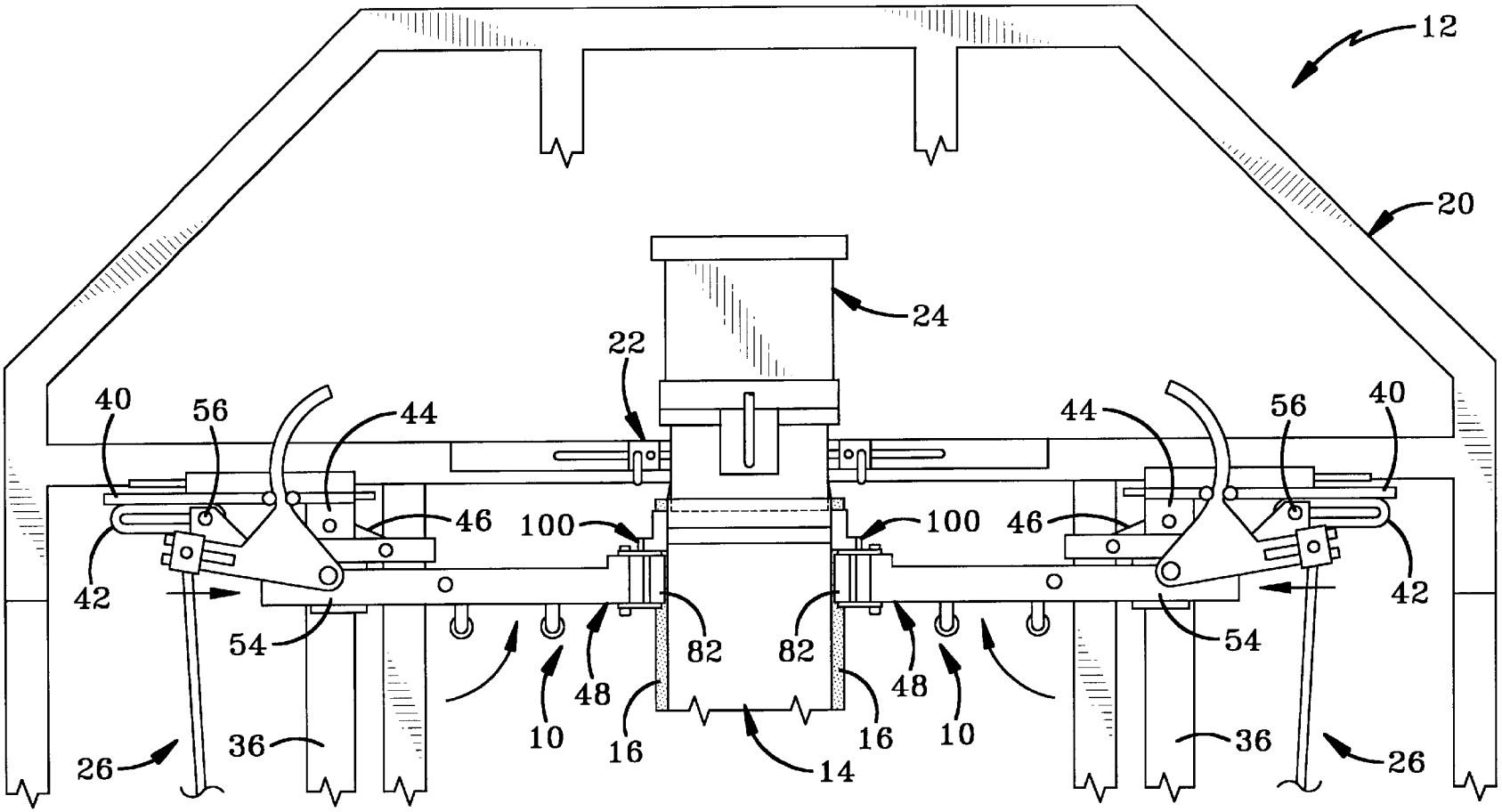
FIG. 32 is a front view showing the alignment and grasping assembly grasping the flanges of the bag.
Figure 33:
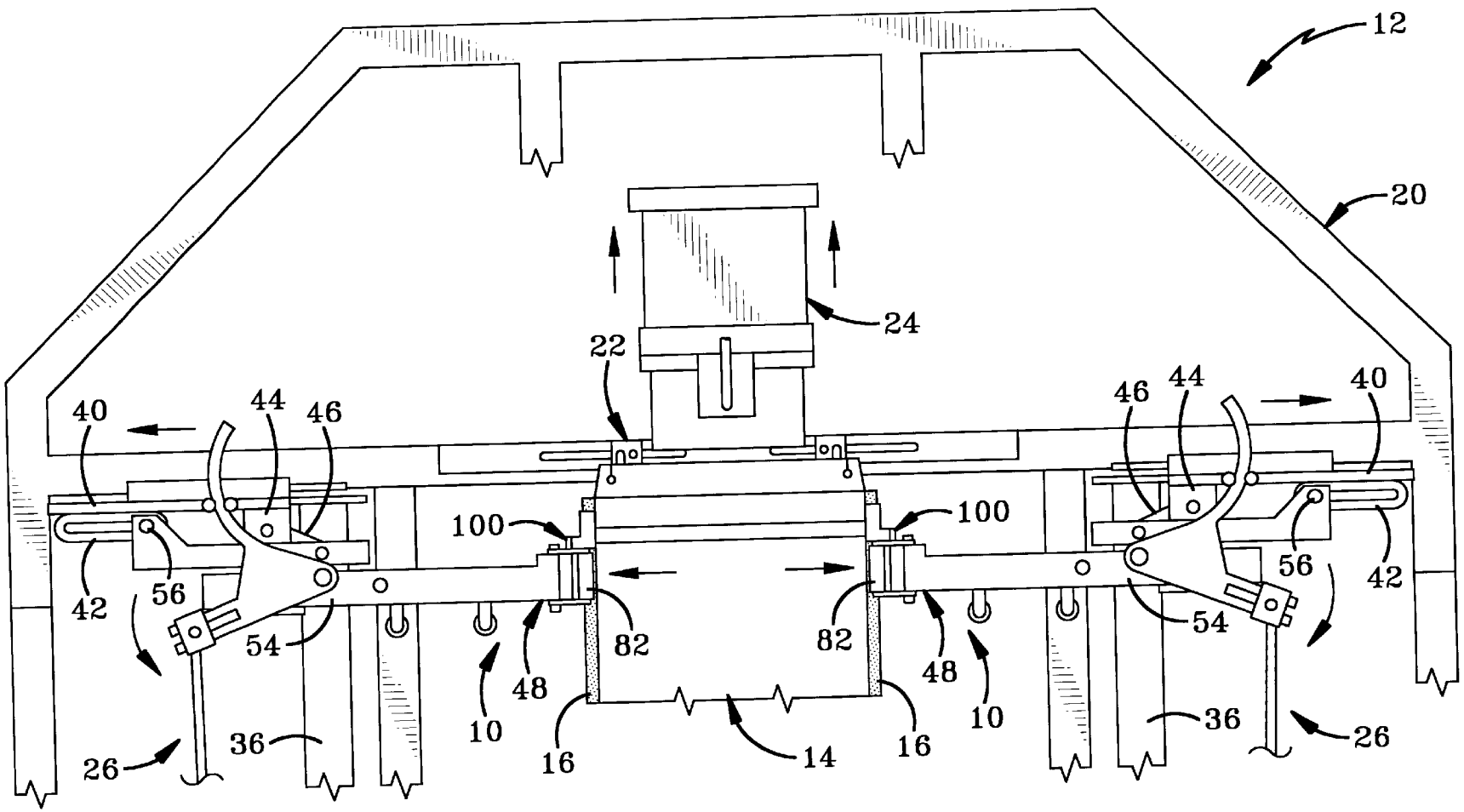
FIG. 33 is a front view showing the bag being pulled tight.

An alternative embodiment of apparatus 10 is depicted in FIGS. 30–33. In this embodiment, jaws 50 and 52 are moved along an arch that moves inwardly and upwardly with respect to bag 14 as depicted in FIGS. 31 and 32. This motion is achieved by flipping hand assemblies 10 upside down along with flipping stationery cam 42, rotary actuator 44 and drive arm 46. One benefit to providing apparatus 10 in the configuration depicted in FIGS. 30–33 is that the upper portion of bag 14 is no longer required because apparatus 10 engages the useable portion of bag 14 below the top of bag 14. This eliminates scrap and allows bags 14 to be fabricated from less material. Funnel assembly 24 must be adjusted to fill bags 14 in this manner and the sealing apparatus must also be adjusted to seal bags held in this manner. Bag holder 22 may also be adjusted to hold bags when wicketed holes are not provided. In another embodiment, a small wicketed flange may be provided at the top of each bag 14 so that bags 14 may be held on bag holder 22. In this embodiment, waste material is substantially reduced.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

What is claimed is:

1. An assembly for grasping a flange on a flexible bag; the flange being movable between collapsed and extended positions; the assembly comprising:

a base having a longitudinal direction;

first and second jaws carried by the base;

the jaws movable between open and closed positions;

the jaws having a leading end, a following end, and a front edge; the front edge defining an opening when the jaws are in the open position; the front edge being closed when the jaws are in the closed position; and a guide disposed adjacent one of the leading end and the following end; the guide adapted to engage the flange of the bag to move the flange to an extended position where the flange may be clamped by the jaws.

2. The assembly of claim 1, wherein the guide includes first and second guide plates; the first and second guide plates being opposed to each other.

3. The assembly of claim 2, wherein the first guide plate moves with the first jaw between the open and closed positions and the second guide plate moves with the second jaw between the open and closed positions.

4. The assembly of claim 2, wherein the first and second jaws are substantially parallel.

5. The assembly of claim 2, wherein the first and second jaws have a longitudinal direction; the guide plates having a longitudinal direction; and the guide plates converging toward the jaws in the longitudinal direction.

6. The assembly of claim 2, wherein the first jaw is spaced from the second jaw a first distance when the first and second jaws are in the open position; each guide plate having a leading end and a following end; the following ends of the guide plates being disposed adjacent the leading ends of the jaws; the leading ends of the guide plates being spaced apart a second distance; the second distance being greater than the first distance.

7. The assembly of claim 1, further comprising means for moving the base inwardly and downwardly with respect to the bag.

8. The assembly of claim 1, further comprising means for moving the base inwardly and upwardly with respect to the bag.

9. The assembly of claim 1, wherein the each jaw includes an upper bracket and a lower bracket; each bracket including first and second arm portions connected together at an elbow; the elbows being pivotally connected to the base.

10. The assembly of claim 9, further comprising a first actuator carried by the base; the actuator being connected to the first arm portions of at least one of the brackets.

11. The assembly of claim 10, wherein the first arm portions of the brackets overlap.

12. The assembly of claim 11, wherein each first arm portion defines a slot; portions of the slots being aligned; a pin being disposed in the aligned portions of the slots; the pin being connected to the actuator.

13. The assembly of claim 9, further comprising grippers connected to the second arm portions of each bracket.

14. The assembly of claim 13, wherein each gripper includes a support and a section of friction material.

15. The assembly of claim 1, wherein the guide is spaced from the jaws.

16. The assembly of claim 1, wherein the guide is carried by the base independent of the jaws.

17. The assembly of claim 1, wherein the guide is carried by the jaws.

18. A method for grasping a flange on a bag in a bag handling apparatus; the method comprising the steps of:

moving a grasping arm from a resting position toward a bag having a flange; the grasping arm having a grasping jaws and a guide;

moving the flange to an extended position with the guide; and grasping the flange with the grasping jaws.

19. The method of claim 18, further comprising the step of moving the grasping arm in an arc with respect to the bag.

20. The method of claim 19, further comprising the step of moving the grasping arm in an arc inwardly and downwardly with respect to the bag.

21. The method of claim 19, further comprising the step of moving the grasping arm in an arc inwardly and upwardly with respect to the bag.

22. The method of claim 18 further comprising the step of engaging the guide with the bag adjacent the flange.

23. The method of claim 22, wherein the guide includes opposed guide plates; the method further comprising the step of positioning the flange in an extended position between the guide plates.

24. The method of claim 23, further comprising the step of clamping the flange with the jaws.

25. In a bag handling machine having a bag filling station where a bag is filled with a material; the improvement comprising:

a pair of grabber arms disposed on opposite sides of the bag;

each grabber arm including jaws adapted to grasp a portion of the bag; and a drive assembly adapted to move the jaws along an arc that moves inwardly and upwardly with respect to the bag so that the jaws will engage the bag; the jaws moving upwardly with respect to the bag when the jaws initially engage the bag.

26. The improvement of claim 25, wherein the bag includes a flange movable between collapsed and extended positions; the improvement further comprising a guide connected to each grabber arm; the guide adapted to move the flange to the extended position where the flange may be clamped by the flange clamping device.

27. The improvement of claim 26, wherein the guide includes first and second guide plates; the first and second guide plates being opposed to each other.

28. The improvement of claim 27, wherein the first and second guide plates converge toward each other.

29. In a bag handling machine having a bag filling station where a bag is filled with a material; the improvement comprising:

a pair of grabber arms disposed on opposite sides of the bag;

each grabber arm including a bag engaging device adapted to engage a portion of the bag; and a drive assembly adapted to move the bag engaging device along an arc that moves inwardly and upwardly with respect to the bag so that the bag engaging device will engage the bag; the bag engaging device moving upwardly with respect to the bag when the bag engaging device initially engages the bag.

30. The improvement of claim 29, wherein the bag includes a flange movable between collapsed and extended positions; the improvement further comprising a guide connected to each grabber arm; the guide adapted to move the flange to the extended position where the flange may be clamped by the flange clamping device.

31. The improvement of claim 30, wherein the guide includes first and second guide plates; the first and second guide plates being opposed to each other.

32. The improvement of claim 31, wherein the first and second guide plates converge toward each other.

33. An assembly for grasping a flange on a flexible bag; the flange being movable between collapsed and extended positions; the assembly comprising:

a base;

a flange clamping device carried by the base; the flange clamping device adapted to clamp the flange on a flexible bag when the flange is in the extended position;

a guide disposed adjacent the flange clamping device; the guide adapted to move the flange to the extended position where the flange may be clamped by the flange clamping device.

34. The assembly of claim 33, wherein the guide includes first and second guide plates; the first and second guide plates being opposed to each other.

35. The assembly of claim 34, wherein the first and second guide plates converge toward each other.

36. The assembly of claim 33, wherein the flange clamping device includes first and second jaws carried by the base;

the jaws movable between open and closed positions;

the jaws having a leading end and a following end; and the guide disposed adjacent the leading end; the guide adapted to engage the flange of the bag to move the flange to an extended position where the flange may be clamped by the jaws.

37. A method for grasping a flange on a bag in a bag handling apparatus; the method comprising the steps of:

moving a grasping arm from a resting position toward a bag having a flange; the grasping arm having a flange clamping device and a guide;

moving the flange to an extended position with the guide; and clamping the flange with the flange clamping device.

38. The method of claim 37, further comprising the step of moving the flange clamping device in an arc with respect to the bag.

39. The method of claim 37, further comprising the step of moving the guide in an arc inwardly and downwardly with respect to the bag.

40. The method of claim 37, further comprising the step of moving the guide in an arc inwardly and upwardly with respect to the bag.

41. The method of claim 37, further comprising the step of engaging the guide with the bag adjacent the flange.

42. The method of claim 41, wherein the guide includes opposed guide plates; the method further comprising the step of positioning the flange in an extended position between the guide plates.

* * * * *